US011622910B2

(12) United States Patent
Newns et al.

(10) Patent No.: US 11,622,910 B2
(45) Date of Patent: Apr. 11, 2023

(54) BALL ROLLER ASSEMBLIES WITH THERMAL COMPONENTS

(71) Applicant: KT HEALTH, LLC, American Fork, UT (US)

(72) Inventors: Jeremy John Newns, Orem, UT (US); Greg Hahn, Orem, UT (US)

(73) Assignee: KT Health, LLC, American Fork, UT (US)

( * ) Notice: Subject to any disclaimer, the term of this patent is extended or adjusted under 35 U.S.C. 154(b) by 11 days.

(21) Appl. No.: 16/055,126

(22) Filed: Aug. 5, 2018

(65) Prior Publication Data

US 2018/0353369 A1 Dec. 13, 2018

Related U.S. Application Data

(60) Provisional application No. 62/541,740, filed on Aug. 6, 2017.

(51) Int. Cl.

| | |
|---|---|
| ***A61H 15/02*** | (2006.01) |
| ***A61H 15/00*** | (2006.01) |
| ***A61H 1/00*** | (2006.01) |

(52) U.S. Cl.

CPC ..... *A61H 15/02* (2013.01); *A61H 1/00* (2013.01); *A61H 15/00* (2013.01);

(Continued)

(58) Field of Classification Search

CPC ..... A61H 7/00; A61H 7/002; A61H 7/003; A61H 7/007; A61H 15/00; A61H 15/0092;

(Continued)

(56) References Cited

U.S. PATENT DOCUMENTS 5,127,395 A * 7/1992 Bontemps ..... A61F 7/10 601/118

2010/0010597 A1* 1/2010 Evans ..... A61F 7/02 607/108

(Continued)

FOREIGN PATENT DOCUMENTS

GB 2538219 A 11/2016

OTHER PUBLICATIONS

USPTO as International Searching Authority, "International Search Report and Written Opinion," International Application No. PCT/US2018/045436, dated Oct. 15, 2018.

(Continued)

*Primary Examiner* — Colin W Stuart

(74) *Attorney, Agent, or Firm* — Dentons Durham Jones Pinegar

(57) ABSTRACT

A ball roller assembly may include an inner sphere that is constructed from a thermal-sensitive material. The ball roller assembly may also include an outer sphere that is constructed from a thermal-conductive material. The inner sphere may be disposed within the outer sphere and thermal transfer may occur between the inner sphere, the outer sphere, and a user of the ball roller assembly. The ball roller assembly may further include a housing constructed from a thermal-insulative material, and the outer sphere and the inner sphere may be disposed within the housing. The inner sphere may be selectively removable from the outer sphere and the outer sphere may be selectively removable from the housing.

20 Claims, 18 Drawing Sheets

(52) U.S. Cl.
CPC ..... *A61H 2015/0042* (2013.01); *A61H 2015/0064* (2013.01); *A61H 2201/0119* (2013.01); *A61H 2201/0157* (2013.01); *A61H 2201/02* (2013.01); *A61H 2201/1253* (2013.01); *A61H 2201/169* (2013.01); *A61H 2201/1671* (2013.01); *A61H 2205/04* (2013.01); *A61H 2205/06* (2013.01); *A61H 2205/081* (2013.01); *A61H 2205/10* (2013.01)

(58) Field of Classification Search
CPC ..... A61H 15/02; A61H 2015/0007; A61H 2015/0028; A61H 2015/0042; A61H 2015/005; A61H 2015/0057; A61H 2015/0064; A61H 2015/0071; A61H 2201/0107; A61H 2201/0157; A61H 2201/02; A61H 2201/0207; A61H 2201/0214; A61H 2201/0257; A61H 2201/0264
See application file for complete search history.

(56) References Cited

U.S. PATENT DOCUMENTS

2014/0336550 A1* 11/2014 Zedaker ..... A61H 7/007 601/131
2015/0005683 A1* 1/2015 Balducci ..... A61H 15/00 601/134
2015/0223970 A1* 8/2015 Holland ..... A61F 7/10 601/19
2015/0265457 A1 9/2015 Connors et al.
2015/0272774 A1* 10/2015 Lee ..... A61F 7/00 601/15
2016/0279017 A1* 9/2016 Hyder ..... A61H 15/0092

OTHER PUBLICATIONS

Canadian Intellectual Property Office, "Examiner's Report," Canadian Application No. 3072199, dated Mar. 15, 2021.
European Patent Office, Extended European search report, European Application No. 18844520.9, dated Mar. 25, 2021.
Chinese National Intellectual Property Administration, "First Office Action," Chinese Application No. 201880060487.9, dated Jul. 6, 2021.
Japan Patent Office, "Notice of Reasons for Rejection," Japanese Application No. 2020-529117, dated Apr. 1, 2021.
Canadian Intelllectual Property Office, "Examiner's Report," Canadian Application No. 3072199, dated Nov. 15, 2021.
Chinese National Intellectual Property Administration, "Second Office Action," Chinese Application No. 201880060487.9, dated Mar. 10, 2022.
Japan Patent Office, "Decision of Rejection," Japanese Application No. 2020-529117, dated Mar. 2, 2022.
China National Intellectual Property Administration, "Third Office Action," Chinese Application No. 201880060487.9, dated Sep. 26, 2022.
Canadian Intellectual Property Office, "Commissioner's Notice—Application Found Allowable," Canadian Application No. 3072199, dated Sep. 29, 2022.

* cited by examiner

BALL ROLLER ASSEMBLIES WITH THERMAL COMPONENTS

CROSS-REFERENCE TO RELATED APPLICATIONS

This application claims priority to and the benefit of U.S. Provisional Patent Application Ser. No. 62/541,740, entitled BALL ROLLER ASSEMBLIES WITH THERMAL COMPONENTS, which was filed on Aug. 6, 2017, and is hereby incorporated by reference in its entirety.

BACKGROUND OF THE INVENTION

Field of the Invention

This application is generally directed towards ball roller assemblies and, in particular, ball roller assemblies with thermal components.

Description of Related Art

Following periods of exercise or following injuries, individuals may benefit from a massage. The massage may reduce inflammation, reduce muscle soreness, assist in flexibility, or provide other benefits. Individuals may use a device to provide a more effective massage. For example, the device may enable a concentration of pressure in a particular portion of muscle. An example of the device is a ball roller assembly.

Current ball roller assemblies may include a round or substantially round ball. The ball may be retained in a handle. Individuals may hold the handle and press the ball into a body part. The individual may then move the ball roller assembly relative to the body part to massage the body part. Accordingly, a benefit of the ball roller assembly is pressure may be imposed by the individual against the body part.

The subject matter claimed herein is not limited to embodiments that solve any disadvantages or that operate only in environments such as those described above. Rather, this background is only provided to illustrate one example technology area where some embodiments described herein may be practiced.

BRIEF SUMMARY OF EXEMPLARY EMBODIMENTS

A need therefore may exist for a ball roller assembly that eliminates the above-described disadvantages and problems.

One aspect may include a ball roller assembly that may include an outer sphere, an inner sphere, and a housing. The outer sphere may include a shell within which a secondary cavity may be defined. In greater detail, the shell may include a first portion that is selectively attached to a second portion via a connection, such as mechanical connection. For example, the first portion may include a first hemisphere shell and the second portion may include a second hemisphere shell. Additionally, the outer sphere may be comprised of a metal and/or the mechanical connection may include a threaded connection. Additionally, the secondary cavity may include a volume that is substantially similar to the volume of the inner sphere such that when the inner sphere is positioned in the secondary cavity, an outer surface of the inner sphere may contact an inner surface of the outer sphere. The inner sphere may be configured to be positioned within the secondary cavity of the outer sphere. The inner sphere may be configured for a change in thermal state. When the inner sphere is positioned in the outer sphere, thermal transfer between the outer sphere and the inner sphere may be enabled. The inner sphere may be comprised of or may include a thermal-sensitive material and the material may have a high specific heat capacity. For instance, the thermal-sensitive material may include a gel that may be configured to be changed to a cooled thermal state to enable thermal transfer between the outer sphere and the inner sphere. The thermal-sensitive material may include a gel that may be configured to be changed to a heated thermal state to enable thermal transfer between the inner sphere and the outer sphere. In detail, the thermal-sensitive material may include a supersaturated solution of sodium acetate in water, sodium polyacrylate, a salt hydrate, a diethylene glycol, an ethylene glycol, an ammonium nitrate, a calcium ammonium nitrate, a paraffin, an urea, or the like. The thermal-sensitive material may be particularly configured to be in the cooled thermal state, heated thermal state, and/or heated and cooled thermal states. The housing may be configured to retain the outer sphere such that the outer sphere is rotatable within the housing. The housing may define a primary cavity that may be configured to retain a portion of the outer sphere. The housing may include a collar, a handle, and a coupling, such as a mechanical coupling, that enables selective coupling between the collar and the handle. The collar may include a ring of material having a first end and a second end. The first end of the collar may define a circular opening having a diameter that is less than a diameter of the outer sphere such that a portion of the outer sphere may protrude from the housing when the outer sphere is positioned in the primary cavity. The second end of the collar may be configured to be attached to the handle. The handle may include at least one structure that is configured to support the outer sphere and retain the outer sphere against the circular opening of the collar.

Another aspect may include a ball roller assembly that may include an outer sphere and a housing. The outer sphere may be constructed from a material such as metal, plastic, composites, and the like. The outer sphere may be comprised of or may include a thermal-sensitive material and the material may have a high specific heat capacity. The thermal-sensitive material may include a gel that may be configured to be changed to a cooled thermal state to enable thermal transfer from the outer sphere. The thermal-sensitive material may include a gel that may be configured to be changed to a heated thermal state to enable thermal transfer from the outer sphere. The thermal-sensitive material may be particularly configured to be in the cooled thermal state, heated thermal state, and/or heated and cooled thermal states. In detail, the thermal-sensitive material may include a supersaturated solution of sodium acetate in water, sodium polyacrylate, a salt hydrate, a diethylene glycol, an ethylene glycol, an ammonium nitrate, a calcium ammonium nitrate, a paraffin, an urea, or the like. The housing may be configured to retain the outer sphere such that the outer sphere is rotatable within the housing. The housing may define a primary cavity that may be configured to retain a portion of the outer sphere. The housing may include a collar, a handle, and a coupling, such as a mechanical coupling, that enables selective coupling between the collar and the handle. The collar may include a ring of material having a first end and a second end. The first end of the collar may define a circular opening having a diameter that is less than a diameter of the outer sphere such that a portion of the outer sphere may protrude from the housing when the outer sphere is positioned in the primary cavity. The second end of the collar may be configured to be attached to the handle. The handle may include at least one structure that is configured to support the outer sphere and retain the outer sphere against the circular opening of the collar.

Yet another aspect may include a method of muscle massage. The method may include changing a thermal state of an inner sphere. The changing the thermal state of an inner sphere may include heating the inner sphere, such as placing the inner sphere in an oven, a microwave oven, or a pan of boiling water. The changing the thermal state of an inner sphere may include cooling the inner sphere, such as placing the inner sphere in a freezer, refrigerator, ice, or another suitable cooling environment. The method may include positioning the inner sphere within a secondary cavity defined by a shell of an outer sphere. The method may include coupling a first portion of the shell to a second portion of the shell such that the inner sphere is retained within the secondary cavity of the shell. The method may include further positioning the outer sphere in a primary cavity of a housing. The method may include further coupling a collar of the housing to a handle of the housing such that the outer sphere is retained in the housing. The method may include placing an outer surface of the outer sphere against a surface such that thermal energy transfers between the surface and the inner sphere. In detail, the shell may include a first portion that is selectively attached to a second portion via a connection, such as a mechanical connection. The first portion may include a first hemisphere shell and the second portion may include a second hemisphere shell. Additionally, the outer sphere may be comprised of a metal and/or the mechanical connection may include a threaded connection. Additionally, the secondary cavity may include a volume that is substantially similar to the volume of the inner sphere such that when the inner sphere is positioned in the secondary cavity, an outer surface of the inner sphere may contact an inner surface of the outer sphere. The housing may define a primary cavity that may be configured to retain a portion of the outer sphere. The housing may include a collar, a handle, and a coupling, such as a mechanical coupling, that enables selective coupling between the collar and the handle. The collar may include a ring of material having a first end and a second end. The first end of the collar may define a circular opening having a diameter that is less than a diameter of the outer sphere such that a portion of the outer sphere may protrude from the housing when the outer sphere is positioned in the primary cavity. The second end of the collar may be configured to be attached to the handle. The handle may include at least one structure that is configured to support the outer sphere and retain the outer sphere against the circular opening of the collar. The inner sphere may be comprised of or may include a thermal-sensitive material and the material may have a high specific heat capacity. The thermal-sensitive material may include a gel that may be configured to be changed to a cooled thermal state to enable thermal transfer between the outer sphere and the inner sphere. The thermal-sensitive material may include a gel that may be configured to be changed to a heated thermal state to enable thermal transfer between the inner sphere and the outer sphere. The thermal-sensitive material may be particularly configured to be in the cooled thermal state, heated thermal state, and/or heated and cooled thermal states. In detail, the thermal-sensitive material may include a supersaturated solution of sodium acetate in water, sodium polyacrylate, a salt hydrate, a diethylene glycol, an ethylene glycol, an ammonium nitrate, a calcium ammonium nitrate, a paraffin, an urea, or the like.

A further aspect may include a method of muscle massage. The method may include changing a thermal state of an outer sphere. The changing the thermal state of the outer sphere may include heating the outer sphere, such as placing the outer sphere in an oven, a microwave oven, or a pan of boiling water. The changing the thermal state of the outer sphere may including cooling the outer sphere, such as placing the outer sphere in a freezer. The method may include positioning the outer sphere in a primary cavity of a housing. The method may include further coupling a collar of the housing to a handle of the housing such that the outer sphere is retained in the housing. The method may include placing an outer surface of the outer sphere against a surface such that thermal energy transfers between the surface and the outer sphere. In detail, the housing may define a primary cavity that may be configured to retain a portion of the outer sphere. The housing may include a collar, a handle, and a coupling, such as a mechanical coupling, that enables selective coupling between the collar and the handle. The collar may include a ring of material having a first end and a second end. The first end of the collar may define a circular opening having a diameter that is less than a diameter of the outer sphere such that a portion of the outer sphere may protrude from the housing when the outer sphere is positioned in the primary cavity. The second end of the collar may be configured to be attached to the handle. The handle may include at least one structure that is configured to support the outer sphere and retain the outer sphere against the circular opening of the collar. The outer sphere may be solid or may have a liquid center. The outer sphere may be comprised of or may include a thermal-sensitive material and the material may have a high specific heat capacity. The thermal-sensitive material may include a gel that may be configured to be changed to a cooled thermal state to enable thermal transfer from the outer sphere. The thermal-sensitive material may include a gel that may be configured to be changed to a heated thermal state to enable thermal transfer from the outer sphere. The thermal-sensitive material may be particularly configured to be in the cooled thermal state, heated thermal state, and/or heated and cooled thermal states. In detail, the thermal-sensitive material may include a supersaturated solution of sodium acetate in water, sodium polyacrylate, a salt hydrate, a diethylene glycol, an ethylene glycol, an ammonium nitrate, a calcium ammonium nitrate, a paraffin, an urea, or the like.

Another aspect is ball roller assembly that may include an outer sphere with a shell and a secondary cavity. An inner sphere may be configured to be disposed within the secondary cavity of the outer sphere and the inner sphere may be configured for a change in thermal state. Thermal transfer between the inner sphere and the outer sphere may be enabled when the inner sphere is positioned in the outer sphere. A housing may be configured to retain the outer sphere such that the outer sphere is rotatable or movable within the housing. The shell of the outer sphere may include a first portion that is selectively attached to a second portion of the shell via a mechanical connection. The first portion of the shell may include a first hemisphere and the second portion of the shell may include a second hemisphere. If desired, the outer sphere may be comprised of a metal and the mechanical connection may include a threaded connection. The secondary cavity may include a volume that is substantially similar to a volume of the inner sphere such that when the inner sphere is positioned in the secondary cavity, an outer surface of the inner sphere may contact an inner surface of the outer sphere. In an exemplary embodiment, the housing may define a primary cavity that is configured to retain a portion of the outer sphere; the housing may include a collar, a handle, and a coupling that enables selective coupling between the collar and the handle; the collar may include a ring of material having a first end and a second end; the first end of the collar may define a circular opening having a diameter that is less than a diameter of the outer sphere such that a portion of the outer sphere may protrude from the housing when the outer sphere is positioned in the primary cavity; the second end of the collar may be configured to be attached to the handle; and the handle may include at least one structure that is configured to support the outer sphere and retain the outer sphere against the circular opening of the collar. The inner sphere may be comprised of or include a thermal-sensitive material having a high specific heat capacity. The thermal-sensitive material may include a gel that is configured to be changed to a cooled thermal state to enable thermal transfer between the outer sphere and the inner sphere. The thermal-sensitive material may also include a gel that is configured to be changed to a heated thermal state to enable thermal transfer between the inner sphere and the outer sphere. The thermal-sensitive material may include a supersaturated solution of sodium acetate in water, sodium polyacrylate, a salt hydrate, a diethylene glycol, an ethylene glycol, an ammonium nitrate, a calcium ammonium nitrate, a paraffin, or an urea.

Still another aspect is a method of muscle massage. The method may include changing a thermal state of an inner sphere; positioning the inner sphere within a secondary cavity of a shell of an outer sphere; coupling a first portion of the shell to a second portion of the shell such that the inner sphere is disposed within the secondary cavity of the shell; disposing the outer sphere in a primary cavity of a housing; and coupling a collar of the housing to a handle of the housing such that the outer sphere is disposed in the housing. The first portion of the shell may be selectively coupled to the second portion of the shell via a mechanical connection; the first portion of the shell may include a first hemisphere and the second portion of the shell may include a second hemisphere; the outer sphere may be comprised of a metal; and the secondary cavity may include a volume that is substantially similar to a volume of the inner sphere such that when the inner sphere is positioned in the secondary cavity, an outer surface of the inner sphere may contact an inner surface of the outer sphere. The housing may define a primary cavity that is configured to retain a portion of the outer sphere; the housing may comprise a collar, a handle, and a coupling that enables selective coupling between the collar and the handle; the collar may include a ring of material having a first end and a second end; the first end of the collar may define a circular opening having a diameter that is less than a diameter of the outer sphere such that a portion of the outer sphere protrudes from the housing when the outer sphere is positioned in the primary cavity; the second end of the collar may be configured to be attached to the handle; and the handle may include at least one structure that is configured to support the outer sphere and retain the outer sphere against the circular opening of the collar. The inner sphere may be comprised of or include a thermal-sensitive material having a high specific heat capacity. The thermal-sensitive material may include a supersaturated solution of sodium acetate in water, sodium polyacrylate, a salt hydrate, a diethylene glycol, an ethylene glycol, an ammonium nitrate, a calcium ammonium nitrate, a paraffin, or an urea. The thermal-sensitive material may include a gel that is configured to be changed to a cooled thermal state to enable thermal transfer between the outer sphere and the inner sphere. The thermal-sensitive material includes a gel that is configured to be changed to a heated thermal state to enable thermal transfer between the inner sphere and the outer sphere.

A further aspect is a ball roller assembly that may include an inner sphere constructed from a thermal-sensitive material and an outer sphere constructed from a thermal-conductive material. The inner sphere may be disposed within the outer sphere and the outer sphere may be configured to allow thermal transfer between the inner sphere, the outer sphere, and a user of the ball roller assembly. The ball roller assembly may also include a housing constructed from a thermal-insulative material, and the outer sphere and the inner sphere may be disposed within the housing. The inner sphere may be selectively removable from the outer sphere and the outer sphere may be selectively removable from the housing. The thermal-sensitive material may be a material that is intended to be heated and/or cooled. For example, the thermal-sensitive material may be intended to be placed in a freezer, a refrigerator, in ice, or another suitable cooling environment. The thermal-sensitive material may also be intended to be placed in an oven, stove, or other suitable heating environment. The thermal-sensitive material may be intended to provide a source of heat or cold for an extended period of time. The thermal-conductive material may be a material that is intended to conduct heat. The thermal-conductive material may have a high thermal-conductivity to allow heat to be readily transferred between the thermal-sensitive material and a user of the ball roller assembly. The thermal-insulative material may be a material that is not intended to conduct heat. The thermal-insulative material may conduct significantly less heat than the thermal-conductive material and may facilitate use of the ball roller assembly because the housing may stay relatively cool or warm in comparison to the temperature of the inner sphere or the outer sphere. For example, if the inner sphere is cooled to provide a cooling environment to the user, the housing may not be significantly cooled because it may be constructed from a thermal-insulative material. If the inner sphere is heated to provide a heating environment to the user, the housing may not be significantly heated because it may be constructed from a thermal-insulative material.

Advantageously, one or more aspects described above may enable the application of a thermal condition or thermal gradient to a user. The user may experience a heating sensation or a cooling sensation. The heating or the cooling sensation may provide a benefit. For example, cooling an injured portion of the body of the user may reduce inflammation. Additionally, heating an injured portion of the body may help relax an injured muscle. Accordingly, the effectiveness of the ball roller may be improved.

These and other aspects, features, and advantages will become more fully apparent from the following brief description of the drawings, the drawings, the detailed description of exemplary embodiments, and appended claims.

It is to be understood that both the foregoing general description and the following detailed description are exemplary and explanatory and are not restrictive of the invention, as claimed.

BRIEF DESCRIPTION OF THE DRAWINGS

The appended drawings contain figures of exemplary embodiments to further illustrate and clarify the above and other aspects, advantages, and features of the present invention. It will be appreciated that these drawings depict only exemplary embodiments of the invention and are not intended to limit its scope. Additionally, it will be appreciated that while the drawings may illustrate preferred sizes, scales, relationships, and configurations of the invention, the drawings are not intended to limit the scope of the claimed invention. The invention will be described and explained with additional specificity and detail through the use of the accompanying drawings in which:

DESCRIPTION OF EXEMPLARY EMBODIMENTS

The present invention is generally directed towards ball roller assemblies with thermal components. The principles of the present invention, however, are not limited to the ball roller assemblies explicitly described or depicted. It will be understood that, in light of the present disclosure, the ball roller assemblies disclosed herein may have a variety of shapes, sizes, configurations, and arrangements. It will also be understood that ball roller assemblies may include any suitable number and combination of features, components, aspects, and the like. In addition, while the ball roller assemblies shown in the accompanying figures are illustrated as having particular styles, it will be appreciated the ball roller assemblies may have any suitable style or configuration.

Additionally, to assist in the description of various exemplary embodiments of the ball roller assemblies, words such as top, bottom, front, rear, sides, right, and left are used to describe the accompanying figures which may be, but are not necessarily, drawn to scale. It will further be appreciated that the ball roller assemblies may be disposed in a variety of desired positions or orientations, and used in numerous locations, environments, and arrangements. A detailed description of exemplary embodiments of the furniture now follows.

Figure 1:
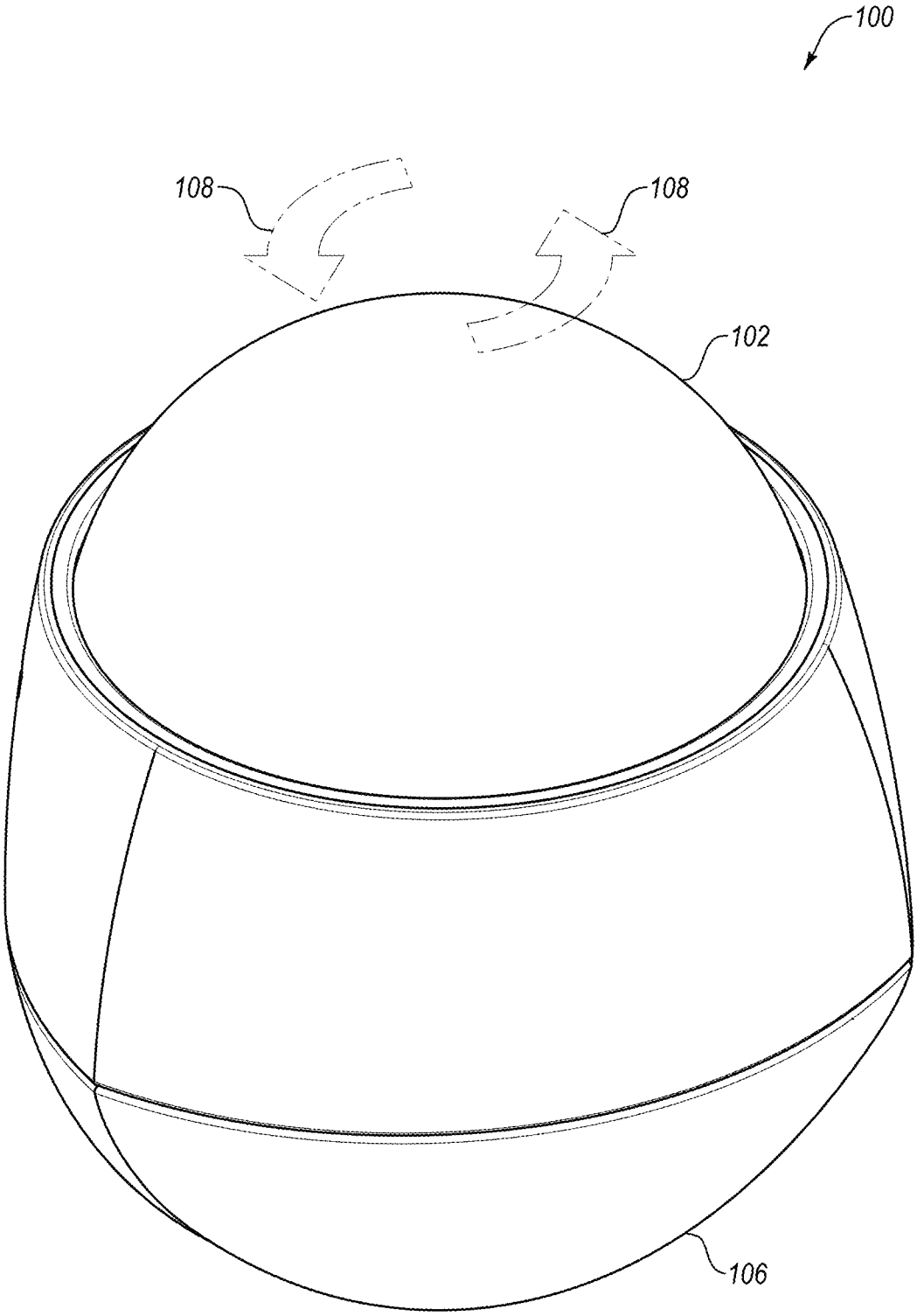
FIG. 1 illustrates an exemplary ball roller assembly.

FIG. 1 illustrates an exemplary ball roller assembly 100. FIG. 1 depicts an assembled perspective view of the ball roller assembly 100. The ball roller assembly 100 of FIG. 1 may be implemented by a user to perform a massage or a pressure-based treatment. For instance, following an injury or a period of exercise, the user may place the ball roller assembly 100 against a body part (e.g., against the skin of the user, positioned the ball roller assembly 100 against clothing covering the body part). The user may then press the ball roller assembly 100 towards their body while moving the ball roller assembly 100 in a circular pattern, a lateral pattern, or in another pattern relative to the user. The ball roller assembly 100 may massage the muscles that it is pressed against, which may reduce soreness and/or promote flexibility or recovery of the muscle. While the ball roller assembly 100 may be described as being used by a user, it will be appreciated that a third party may use the ball roller.

In FIG. 1, the ball roller assembly 100 may include an outer sphere 102 and a housing 106. In some circumstance, the outer sphere 102 may be positioned in the housing 106 as depicted in FIG. 1. The housing 106 may retain the outer sphere 102 and may enable the outer sphere 102 to rotate in the housing 106. For example, the ball roller assembly 100 may be held by the housing 106. The ball roller assembly 100 may be moved relative to the user while the outer sphere 102 is in contact with the user. As the ball roller assembly 100 is moved, the housing 106 may remain in fixed or substantially fixed orientation relative to the hand of the user. The outer sphere 102 may maintain contact with the user and rotate in the housing 106. In FIG. 1, arrows 108 may depict relative rotational motion of the outer sphere 102 relative to the housing 106.

In other circumstance, the outer sphere 102 may be removed from the housing 106. In these circumstances, the outer sphere 102 may be placed in contact with the user. The outer sphere 102 may then be pressed against the user as described above without use of the housing 106. Following use, the outer sphere 102 may be re-positioned in the housing 106.

The ball roller assembly 100 may be configured to enable transfer of thermal energy, such as transfer of thermal energy between at least a portion of the ball roller assembly 100 and the user. For example, the ball roller assembly 100 may be configured to enable transfer of thermal energy between the user and the outer sphere 102. In some embodiment, the outer sphere 102 may be a solid structure. In these and other embodiments, the outer sphere 102 may be placed in an environment in which a thermal state may be changed. For instance, prior to use, the outer sphere 102 may be placed in a freezer, refrigerator, or ice water to cool the outer sphere 102. The ball roller assembly 100 may then be placed against the user. Thermal energy may then transfer between the user and the ball roller assembly 100, which may result in a cooling effect being experienced by the user. Additionally or alternatively, the outer sphere 102 may be placed in an oven or heated water to heat the outer sphere 102. The ball roller assembly 100 may then be placed against the user. Thermal energy may transfer between the ball roller assembly 100 and the user, which may result in a heating effect felt by the user.

In some embodiments, the outer sphere 102 may include a separable structure. In these and other embodiments, the ball roller assembly 100 may include an inner sphere (shown and described below). The inner sphere may be configured to be positioned within the outer sphere 102. The inner sphere may be heated or be cooled and then positioned within the outer sphere 102. Thermal energy may then be transferred between the outer sphere 102, the user, and the inner sphere. For instance, the inner sphere may be cooled and positioned in the outer sphere 102. The outer sphere 102 may then be placed in contact with the user. Thermal energy may then pass between the user, the outer sphere 102, and the inner sphere. The user may accordingly experience a cooling sensation. Similarly, the inner sphere may be heated and positioned in the outer sphere 102. The outer sphere 102 may then be placed in contact with the user. Thermal energy may then pass between the inner sphere, the outer sphere 102, and the user. The user may accordingly experience a heating sensation. After reviewing this disclosure, it will be appreciated that transfer of thermal energy may be by conduction, convention, and/or radiation. Some additional details of these exemplary embodiments are provided below.

Throughout this application, some components may be referred to as spheres for convenience and readability. It will be understood, with the benefit of this disclosure, that components labeled as spheres may be substantially spheres, circular shapes, balls, spheroids, globes, and the like. In some embodiments, the spheres described in the present disclosure may not include exact spherical shapes. For example, the spheres may have other shapes such as elliptical, oblong, egg-shaped, pear-shaped, and the like. After reviewing this disclosure, it will be understood that these components may have other suitable shapes, sizes, configurations, and/or arrangements depending, for example, upon the intended use of the ball roller assembly 100.

Figure 2A:
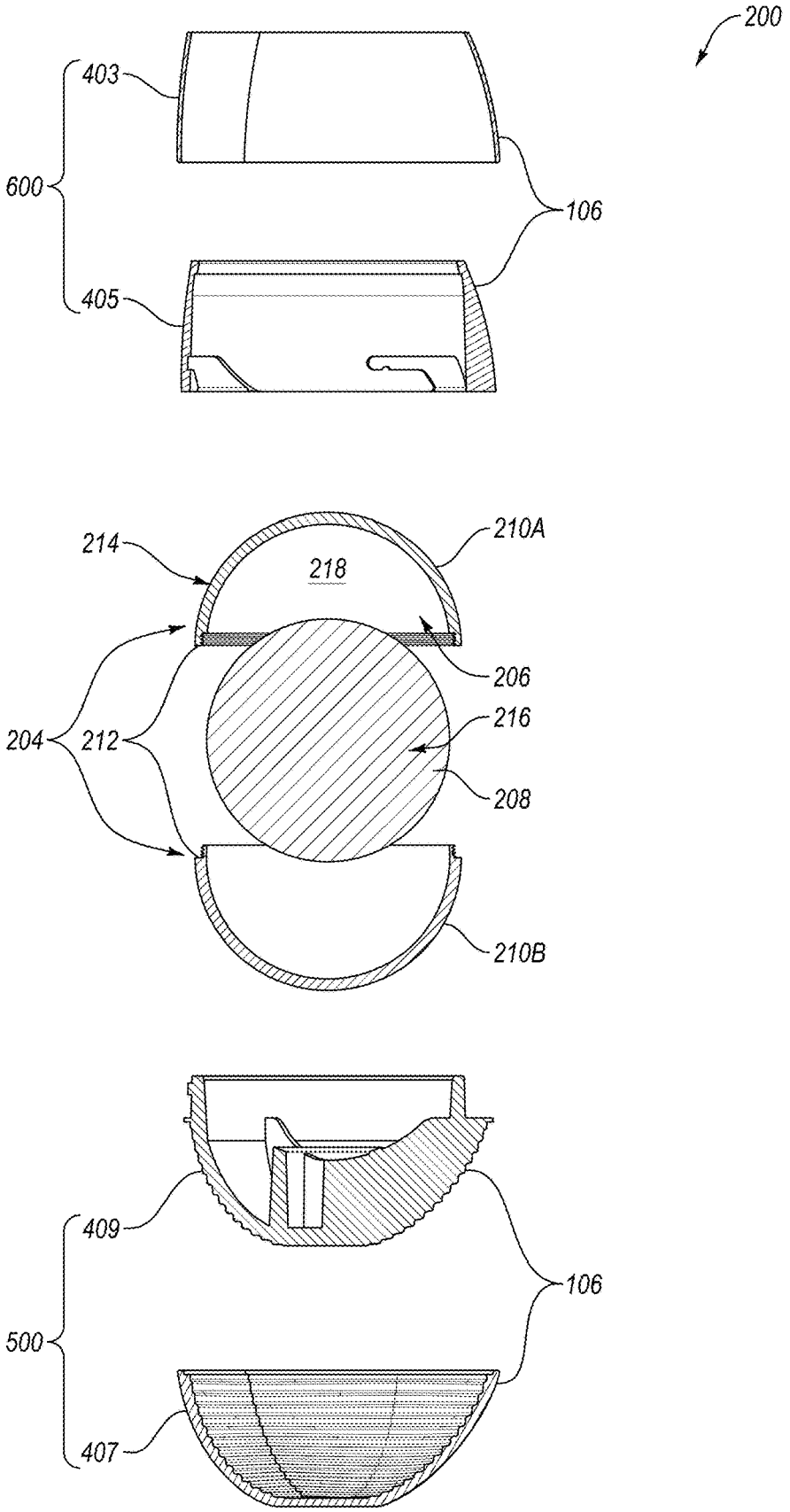
FIG. 2A illustrates an exploded cross-sectional side view of an exemplary separable ball roller assembly.
Figure 2B:
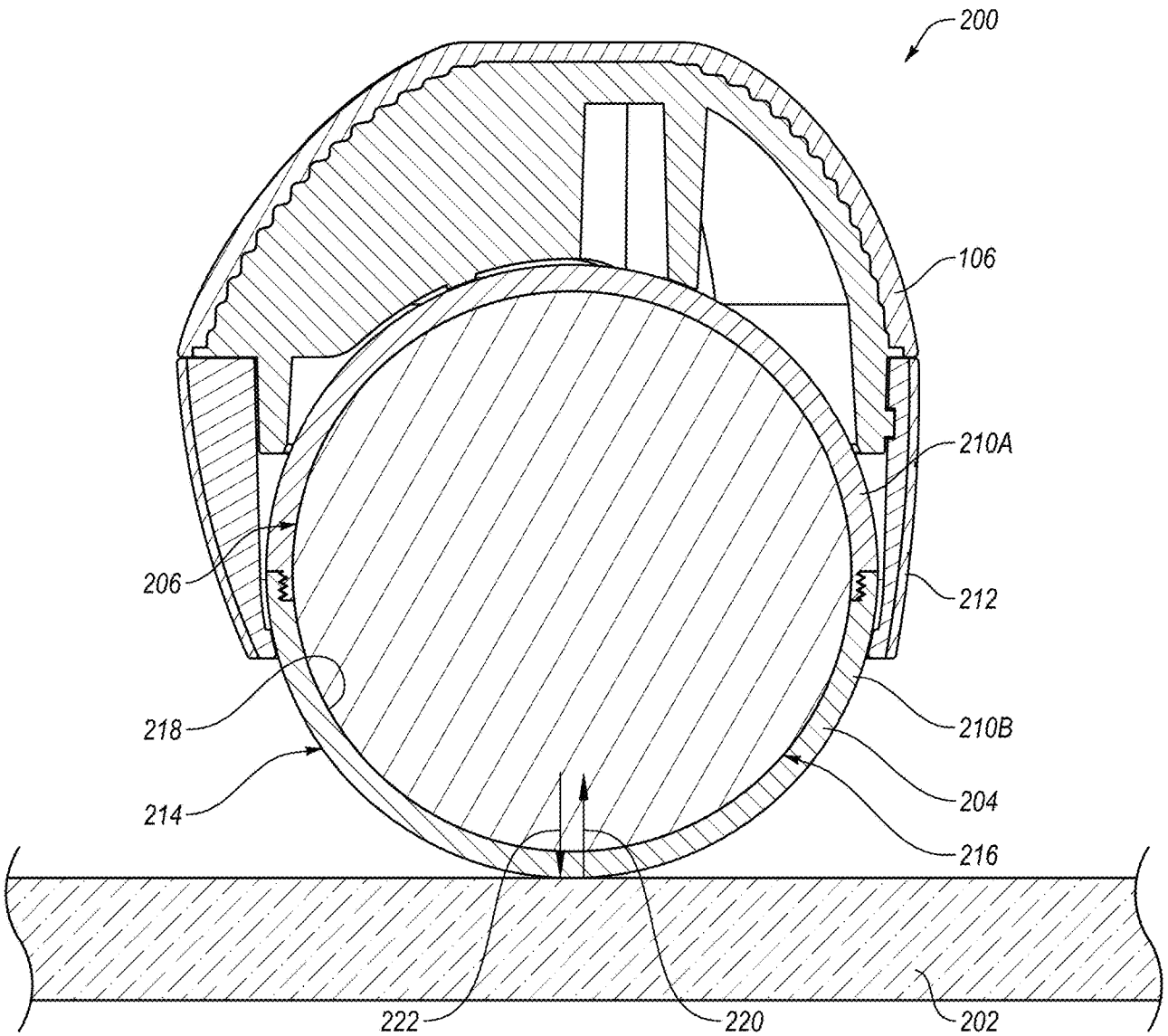
FIG. 2B illustrates an enlarged cross-sectional side view of the separable ball roller assembly shown in FIG. 2A.

FIGS. 2A and 2B depict an exemplary separable ball roller assembly 200. The separable ball roller assembly 200 may be an embodiment of the ball roller assembly 100 of FIG. 1. FIG. 2A depicts a sectional exploded view of the separable ball roller assembly 200. FIG. 2B depicts a sectional assembled view of the separable ball roller assembly 200 in contact with a surface 202.

The separable ball roller assembly 200 of FIGS. 2A and 2B may include a separable outer sphere 204, an inner sphere 208, and the housing 106 of FIG. 1. The separable outer sphere 204 may be substantially similar and may correspond to the outer sphere 102 of FIG. 1.

The separable outer sphere 204 may be comprised of a shell within which a secondary cavity 206 may be disposed and/or defined. For example, the shell of the separable outer sphere 204 may include a first portion 210A that is selectively attached to a second portion 210B via a connection, such as a mechanical connection 212. The mechanical connection 212 might include a threaded connection, a press-fit connection, magnetic connection, combinations thereof, or another suitable connection. Separation of the first portion 210A from the second portion 210B may enable access to the secondary cavity 206. For instance, when the first portion 210A is separate from the second portion 210B, the inner sphere 208 may be positioned in a portion of the secondary cavity 206 defined by the first portion 210A or the second portion 210B. The other of the first portion 210A or the second portion 210B may be coupled, such as mechanically coupled, to the first portion 210A or the second portion 210B, which may enclose the inner sphere 208 within the secondary cavity 206 of the separable outer sphere 204.

In this and other exemplary embodiments, the first portion 210A may include a first hemisphere shell. Additionally, the second portion 210B may include a second hemisphere shell. The first hemisphere shell may include a first portion of the mechanical connection 212 (e.g., male threads). The second hemisphere shell may include a second portion of the mechanical connection 212 (e.g., female threads). The first hemisphere shell and the second hemispherical shell may be configured to mechanically connect to construct the separable outer sphere 204.

In some embodiments, the separable outer sphere 204 may include three or more portions. For example, the separable outer sphere 204 may include a central ring with two end portions. Additionally or alternatively, the separable outer sphere 204 may include two portions that are not hemisphere shells. For instance, one of the two portions may include more than a hemisphere.

In the exemplary embodiment shown in FIGS. 2A and 2B, the separable outer sphere 204 may include a solid outer surface 214 that may be substantially smooth or smooth. In some embodiments, the separable outer sphere 204 may defined by or include one or more holes and/or may include an outer surface on which a pattern (e.g., small bumps or ridges) is defined. The outer surface 214 may also include one or more protrusions and/or recesses depending, for example, upon the intended use of the ball roller assembly 100.

The separable outer sphere 204 may be comprised of material that conducts or facilitates transfer of thermal energy. For instance, the separable outer sphere 204 may be comprised of a metal or a metal alloy such as aluminum, copper, steel, etc. In some embodiments, the separable outer sphere 204 may be comprised of another material such as a plastic (e.g., poly(methyl methacrylate) (PMMA), polypropylene (PP), polyethylene terephthalate (PET), etc.), a ceramic, or the like.

In some embodiments, the secondary cavity 206 may include a volume that is substantially similar to the volume of the inner sphere 208. For example, the secondary cavity 206 may be defined such that when the inner sphere 208 is positioned in the secondary cavity 206, an outer surface 216 of the inner sphere 208 may contact an inner surface 218 of the separable outer sphere 204. In some embodiments, the secondary cavity 206 may include a volume that is configured to contact a portion of the inner sphere 208. For example, the volume of the secondary cavity 206 may be somewhat larger than the inner sphere 208, which may compensate for changes in volumes of the inner sphere 208 because of temperature changes.

The inner sphere 208 may be configured for a change in thermal state. For example, the inner sphere 208 may be comprised of or may include a thermal-sensitive material. Examples of thermal-sensitive materials may include materials having a specific heat capacity that is above that of water. For example, the thermal-sensitive material may include a gel, such as a refrigerant gel. The gel, such as the refrigerant gel, may be configured to be changed to a cooled thermal state to enable thermal transfer from the separable outer sphere 204 to the inner sphere 208. Additionally, the thermal-sensitive material may include a gel, such as a refrigerant gel, that is configured to be changed to a heated thermal state to enable thermal transfer from the inner sphere 208 to the separable outer sphere 204. In embodiments described in the present disclosure, the thermal-sensitive material may include a supersaturated solution of sodium acetate in water, a sodium polyacrylate, a salt hydrate, a diethylene glycol, an ethylene glycol, an ammonium nitrate, a calcium ammonium nitrate, a paraffin, an urea, combinations thereof, or another suitable material.

Referring to FIG. 2B, the inner sphere 208 may be heated or be cooled prior to being positioned within the separable outer sphere 204. Thermal energy may then be transferred between the separable outer sphere 204 and the inner sphere 208. For instance, the inner sphere 208 may be cooled by placing the inner sphere 208 in a freezer, a refrigerator, an ice-water bath, or another suitable cooling environment. Following some period of time (e.g., 10 minutes or another appropriate period of time), a thermal state of the inner sphere 208 may change. For instance, a temperature of the inner sphere 208 may be reduced.

The inner sphere 208 may then be positioned in the secondary cavity 206 of the separable outer sphere 204. The separable outer sphere 204 may then be placed in connect with a surface 202. In greater detail, the outer surface 214 of the separable outer sphere 204 may then be placed in contact with the surface 202. The surface 202 may contact an extremity (e.g., arm or leg) or another body part (e.g., back or neck) of the user. Thermal energy may then pass between the surface 202, the separable outer sphere 204, and the inner sphere 208. An exemplary transfer of thermal energy is represented in FIG. 2B by arrow 220. The separable ball roller assembly 200 may accordingly cool the surface 202.

Similarly, the inner sphere 208 may be heated by placing the inner sphere 208 in an oven, a microwave oven, hot water, etc. Following some period of time (e.g., 10 minutes or another suitable period of time), the thermal state of the inner sphere 208 may change. For instance, a temperature of the inner sphere 208 may increase. The inner sphere 208 may then be positioned in secondary cavity 206 of the separable outer sphere 204. The separable outer sphere 204 may then be placed in contact with the surface 202. In greater detail, the outer surface 214 of the separable outer sphere 204 may then be placed in contact with the surface 202. Thermal energy may then transfer between the inner sphere 208, the surface 202, and the separable outer sphere 204. An exemplary transfer of thermal energy is represented in FIG. 2B by arrow 222. The separable ball roller assembly 200 may accordingly heat the surface 202.

In the embodiment of FIGS. 2A and 2B, the separable ball roller assembly 200 may include an inner sphere 208. In other embodiments, the separable ball roller assembly 200 may include two or more inner spheres 208. In these and other embodiments, each of the two or more inner spheres 208 may be configured for a particular change in thermal state. For instance, the separable ball roller assembly 200 may include a first inner sphere for cooling and a second inner sphere for heating. While the inner sphere 208 may be illustrated and/or described as a sphere, it will be appreciated after reviewing this disclosure that the sphere could have any suitable size, shape, configuration, and/or arrangement. Moreover, the inner sphere 208 could have an amorphous, flexible, malleable, changeable and/or irregular outer surface.

Figure 3A:
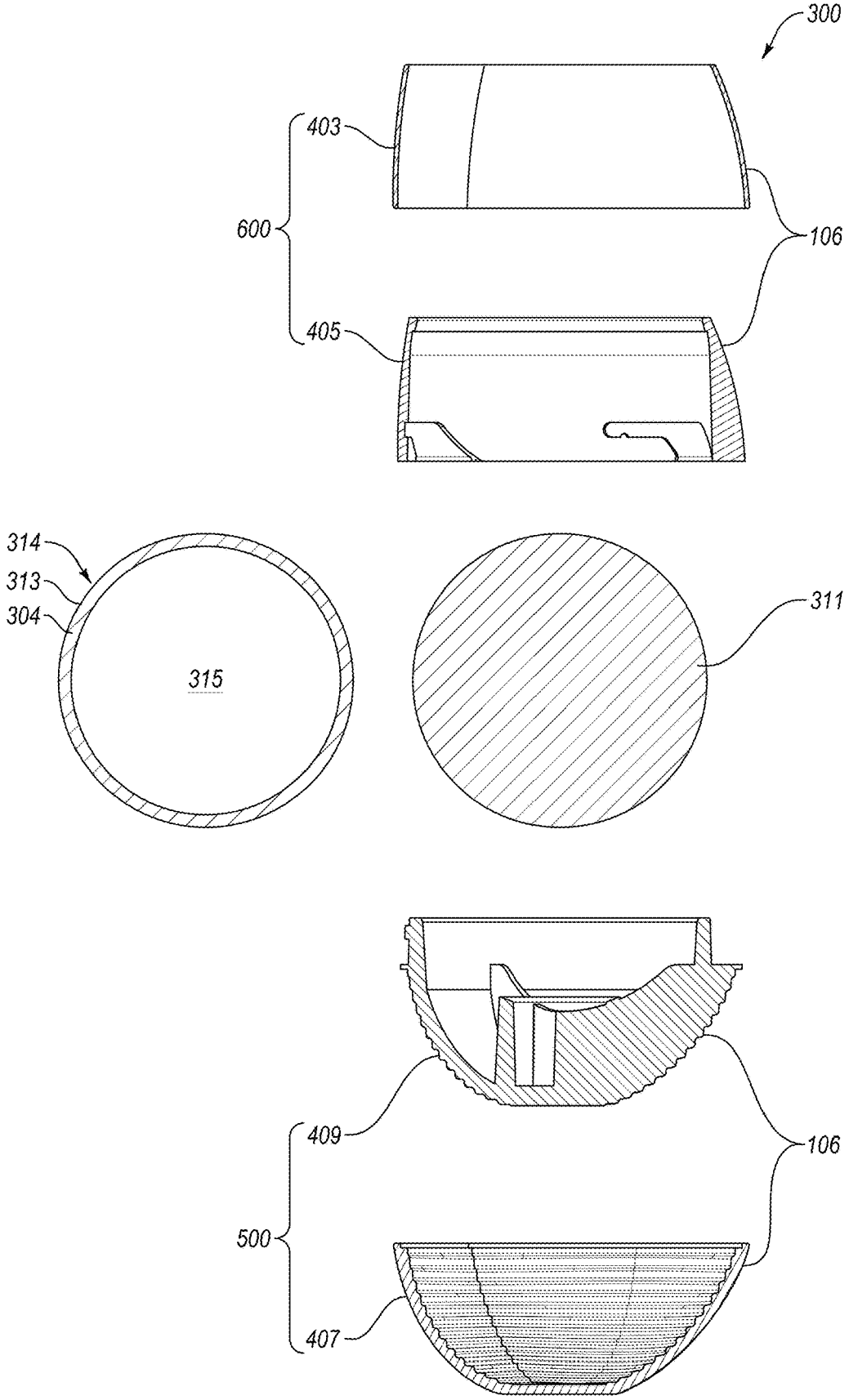
FIG. 3A illustrates an exploded cross-sectional side view of an exemplary solid ball roller assembly.
Figure 3B:
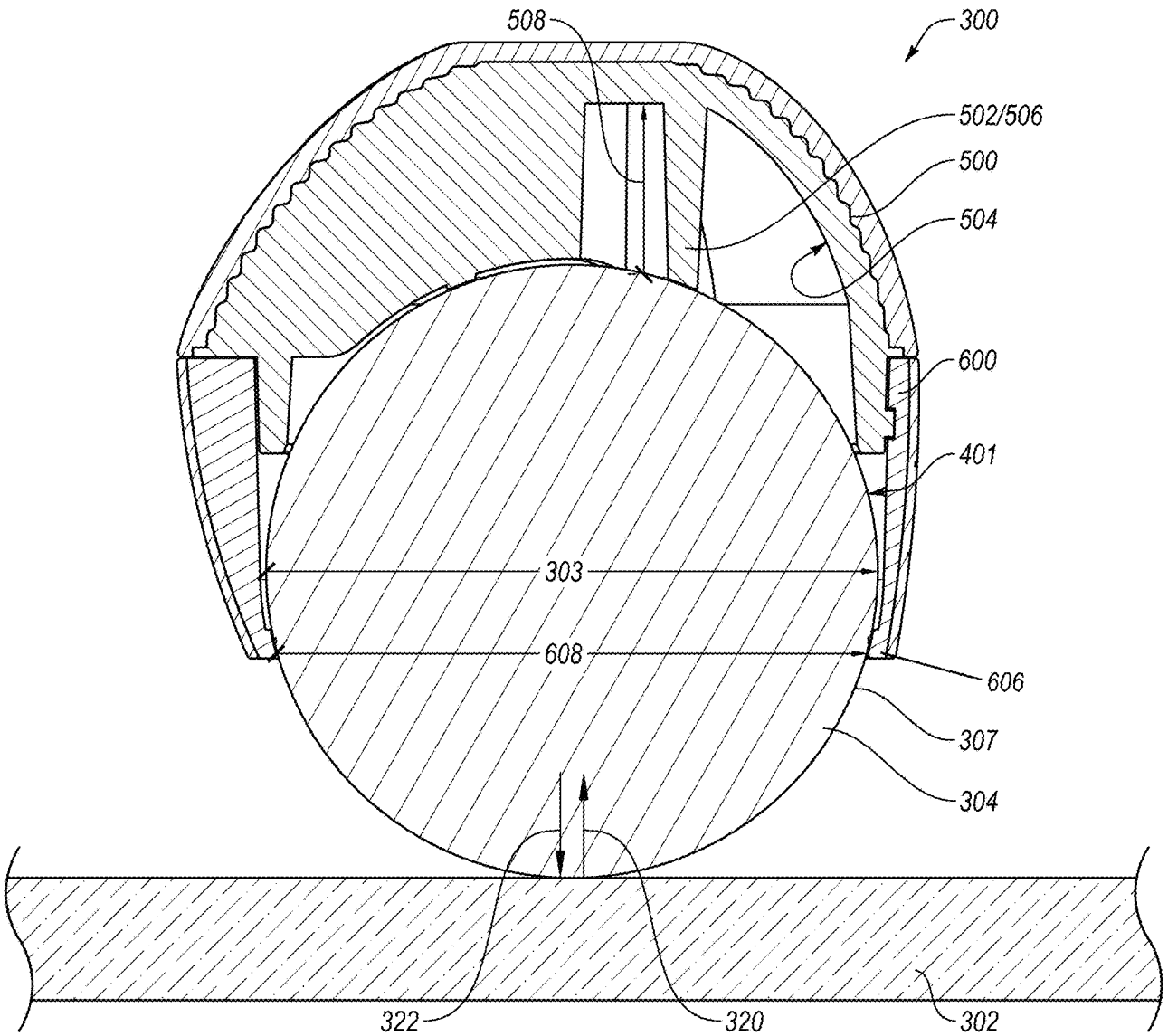
FIG. 3B illustrates an enlarged cross-sectional side view of the solid ball roller assembly of FIG. 3A.

FIGS. 3A and 3B depict an exemplary solid ball roller assembly 300. The solid ball roller assembly 300 may be an embodiment of the ball roller assembly 100 of FIG. 1. FIG. 3A depicts a sectional exploded view of the solid ball roller assembly 300. FIG. 3B depicts a sectional assembled view of the solid ball roller assembly 300 in contact with a surface 302. The solid ball roller assembly 300 of FIGS. 3A and 3B may include a solid outer sphere 304 and the housing 106 of FIG. 1. The solid outer sphere 304 may be substantially similar and may correspond to the outer sphere 102 of FIG. 1. As used with to describe the solid ball roller, the term "solid" indicates that the outer sphere 304 is not configured or intended to be separated into one or more parts (e.g., two hemisphere shells). The solid ball roller may be an integral, one-piece structure and the solid ball roller may include any suitable number of components.

In greater detail, the solid outer sphere 304 may be formed of a single material 311 or may be formed of multiple materials 313 and 315. For example, in embodiments in which the solid outer sphere 304 includes the single material 311, the solid outer sphere 304 may be comprised entirely of a metal or a metal alloy, such as steel, aluminum, etc. Alternatively, the solid outer sphere 304 may be composed entirely of a non-metallic material. For example, the solid outer sphere 304 may be composed entirely of a ceramic or a polymer (e.g., poly(methyl methacrylate) (PMMA), polypropylene (PP), polyethylene terephthalate (PET), etc.). The single material 311 of the solid outer sphere 304 may include the thermal-sensitive material described above.

In embodiments in which the solid outer sphere 304 includes the multiple materials 313 and 315, the solid outer sphere 304 may include an outer shell of a first material 313. An interior material 315 may be disposed within the outer shell. The outer shell may be comprised of a metal or metal alloy, a polymer, or a ceramic. The interior material 315 and/or the material 313 of the outer shell may be comprised at least partially of the thermal-sensitive material.

The interior material 315 may be retained in the outer shell. For example, the interior material 315 may not be removable or readily removable (e.g., without damaging the outer shell) from the solid outer sphere 304. In some embodiments, the interior material 315 may include a liquid.

The solid outer sphere 304 may be configured for a change in thermal state. For example, the solid outer sphere 304 may be configured to be changed to a cooled thermal state to enable thermal transfer to the solid outer sphere 304 or configured to be changed to a heated thermal state to enable thermal transfer from the solid outer sphere 304.

In the embodiment of FIGS. 3A and 3B, the solid outer sphere 304 may include a solid outer surface 314 that may be substantially smooth or smooth. In some embodiments, the solid outer sphere 304 may defined by or include one or more holes and/or may include an outer surface on which a pattern is defined. The outer surface 314 may also include one or more protrusions and/or recesses depending, for example, upon the intended use of the ball roller assembly 100.

Referring to FIG. 3B, the solid outer sphere 304 may be heated or be cooled prior to being positioned in contact with the surface 302. Thermal energy may then be transferred between the solid outer sphere 304 and the surface 302. For instance, the solid outer sphere 304 may be cooled by placing the solid outer sphere 304 in a freezer, a refrigerator, an ice-water bath, or another suitable cooling environment. Following some period of time (e.g., 10 minutes or another suitable period of time), a thermal state of the solid outer sphere 304 may change. For instance, a temperature of the solid outer sphere 304 may be reduced. In particular, the single material of the solid outer sphere 304 may be cooled. Alternatively, the outer shell and/or the interior material may be cooled.

The solid outer sphere 304 may then be positioned in a primary cavity 401 defined by the housing 106. The solid outer sphere 304 or the outer surface 314 thereof may then be placed in contact with the surface 302. The surface 302 may include an extremity (e.g., arm or leg) or another body part (e.g., back or neck) of the user. Thermal energy may then pass between the surface 302 and the solid outer sphere 304. An exemplary transfer of thermal energy is represented in FIG. 3B by arrow 320. The solid ball roller assembly 300 may accordingly cool the surface 302.

Similarly, the solid outer sphere 304 may be heated by placing the solid outer sphere 304 in an oven, a microwave oven, hot water, etc. Following some period of time (e.g., 10 minutes or another suitable period of time), a thermal state of the solid outer sphere 304 may change. For instance, a temperature of the solid outer sphere 304 may increase. In particular, the single material of the solid outer sphere 304 may be heated. Alternatively, the outer shell and/or the interior material may be heated.

The solid outer sphere 304 may then be positioned in the primary cavity 401 defined by the housing 106. The solid outer sphere 304 or the outer surface 314 thereof may then be placed in contact with the surface 302. Thermal energy may then pass between the solid outer sphere 304 and the surface 302. An exemplary transfer of thermal energy is represented in FIG. 3B by arrow 322. The solid ball roller assembly 300 may accordingly heat the surface 302.

Figure 4:
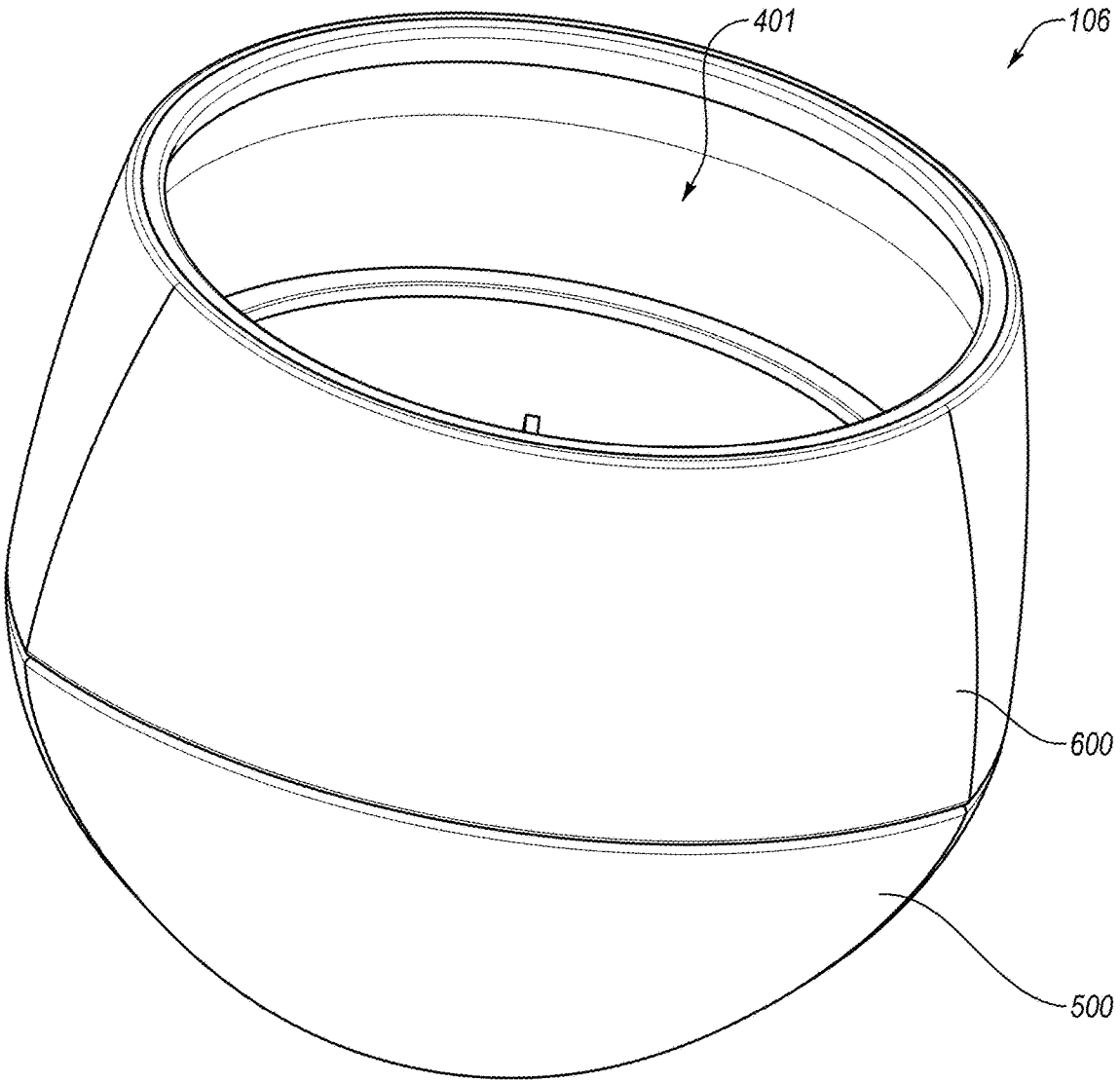
FIG. 4 illustrates a perspective view of an exemplary housing, the exemplary housing may be implemented in the ball roller assembly of FIG. 1, the separable ball roller assembly of FIG. 2A, and/or the solid ball roller assembly of FIG. 3A.

FIG. 4 depicts the housing 106 according to at least one embodiment, which may be described in connection with one or more exemplary embodiments. For example, the housing 106 shown in FIG. 4 is described in connection with the exemplary embodiment shown in FIG. 3A, which depicts an exploded view of the housing 106. The housing 106 may be configured to retain an outer sphere such as the outer sphere 102, the separable outer sphere 204, the solid outer sphere 304, and the like. The housing 106 may be configured to retain the outer sphere such that the outer sphere is rotatable or movable within the housing 106. For instance, as a user moves the ball roller assembly, the orientation of the housing 106 may remain at a substantially consistent orientation and the outer sphere may rotate or more within the housing 106.

The housing 106 may define at least a portion of the primary cavity 401 that is configured to retain a portion of the outer sphere. The primary cavity 401 may be open at a top of the housing 106 and may be sized to enable a portion of the outer sphere to protrude from the housing 106.

The housing 106 may include a collar 600, a handle 500, and a coupling, such as a mechanical coupling, that enables selective coupling between the collar 600 and the handle 500. The mechanical coupling may include two or more elements. One or more of the elements may be defined on the collar 600 and one or more of the elements may be defined on the handle 500.

As best seen in FIG. 3A, the collar 600 may include a cover 403 and an upper housing 405. The cover 403 may be adhered to or otherwise be placed on the upper housing 405. The cover 403 may smooth the surface of the upper housing 405 and may provide a surface with a texture, which may allow the user to grip the collar 600.

The handle 500 may include a handle cover 407 and a lower housing 409. The handle cover 407 may be adhered to or otherwise be placed on the lower housing 409. The handle cover 407 may smooth the surface of the lower housing 409 and may provide a surface with a texture, which may allow the user to grip the handle 500.

Figure 5:
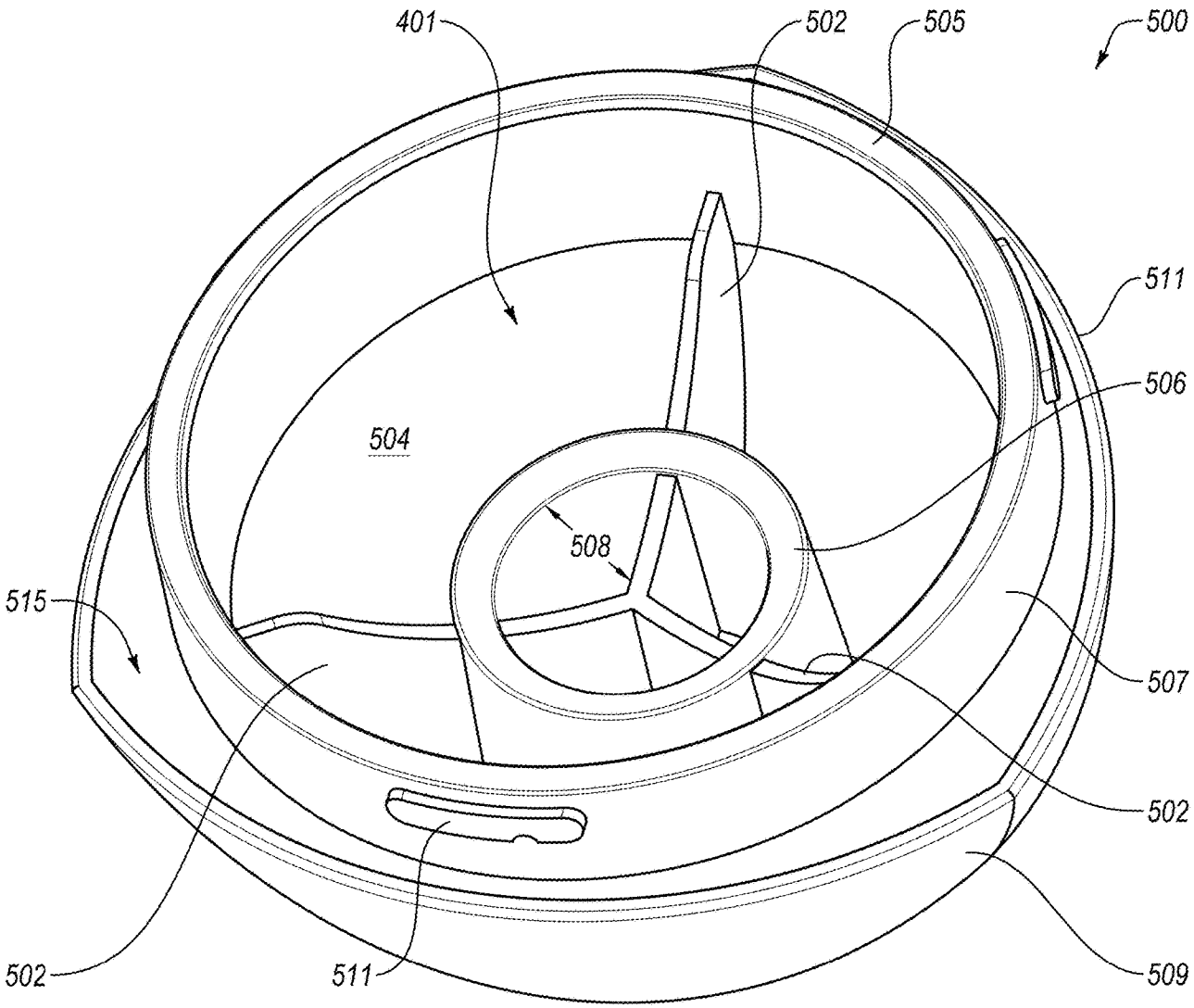
FIG. 5 illustrates a perspective view of an exemplary handle, the exemplary handle may be implemented in the housing of FIG. 4.

FIG. 5 illustrates an exemplary handle 500 that may be implemented in the housing 106. The exemplary handle 500 is also depicted in FIGS. 2A-3B and 4. The handle 500 may define a portion of the primary cavity 401 of FIG. 4. The handle 500 may include one or more structures 502. The structures 502 may protrude from an inner surface 504 into the primary cavity 401. The structures 502 may be configured to support an outer sphere (e.g., the outer sphere 102, the separable outer sphere 204, or the solid outer sphere 304). In the depicted embodiment, the structure 502 may include ring-shape protrusion 506. The ring-shape protrusion 506 may be configured to correspond to the shape of the outer sphere. Also, the ring-shape protrusion 506 may extend from the inner surface 504 a particular height 508. The particular height 508 may be sized such that the outer sphere is retained against a collar such as the collar 600 described elsewhere in the present disclosure.

For example, with reference to FIGS. 3B and 5, the structures 502 may protrude from the inner surface 504 into the primary cavity 401. The structures 502 may be configured to support the solid outer sphere 304. The ring-shape protrusion 506 may extend from the inner surface 504 the particular height 508 such that the solid outer sphere 304 is retained against the collar 600. In particular, the ring-shape protrusion 506 may retain the solid outer sphere 304 against the opening 606.

Referring back to FIG. 5, the handle 500 may include a first end 505. The first end 505 may include a generally cylindrical structure 507. The cylindrical structure 507 may extend from a rounded triangular portion 509. A first element 511 of the mechanical coupling may extend from the cylindrical structure 507.

Figure 6:
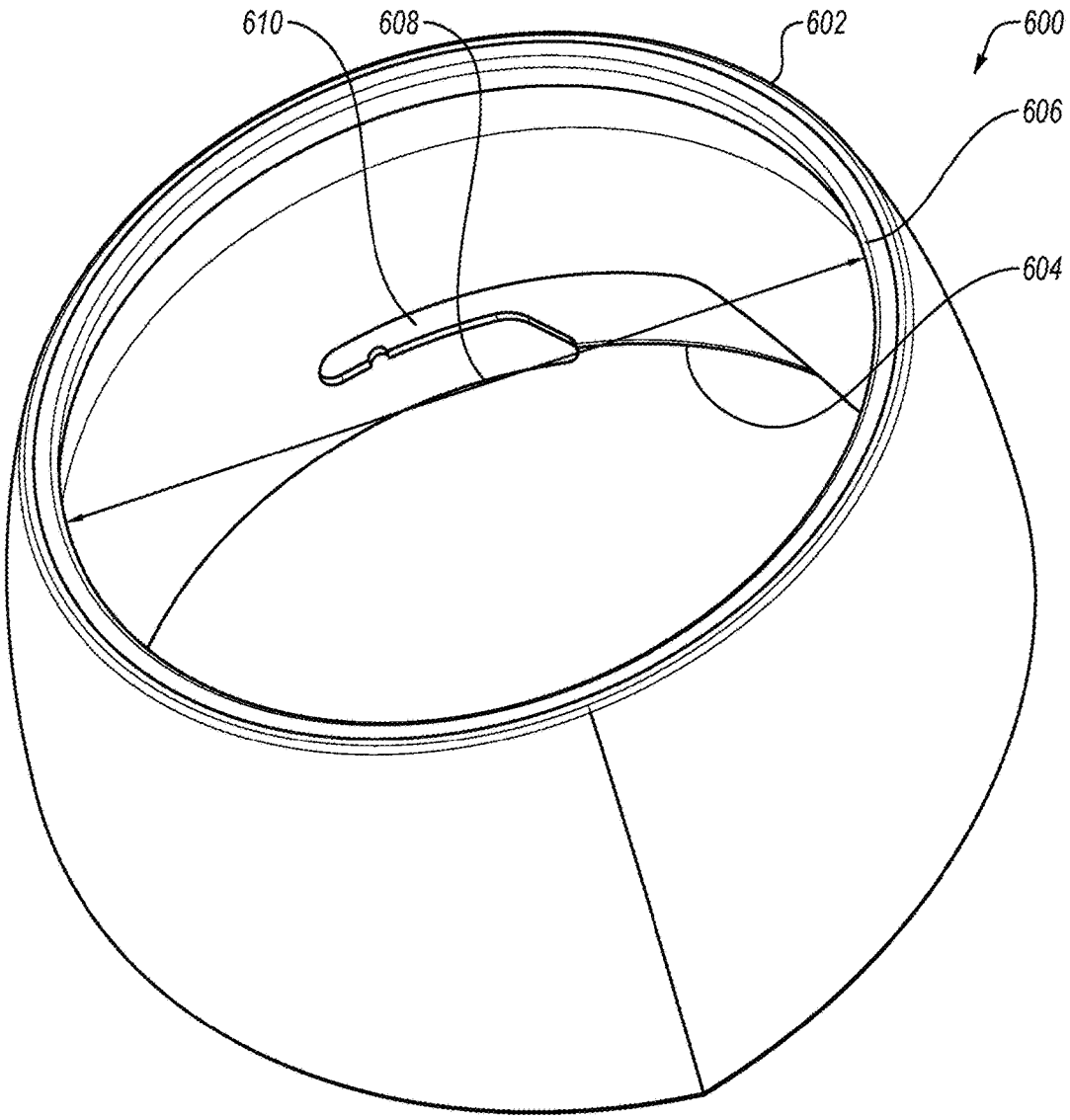
FIG. 6 illustrates a perspective view of an exemplary collar, the exemplary collar may be implemented in the housing of FIG. 4.

FIG. 6 illustrates an exemplary collar 600 that may be implemented in the housing 106. The collar 600 is also depicted in FIGS. 2A-3B and 4. The collar 600 may generally include a ring of material. The ring of material may have a first end 602 and a second end 604. The first end 602 of the collar 600 may define a circular or substantially circular opening 606. The opening 606 may have a diameter 608 that is less than a diameter of an outer sphere such as the outer sphere 102, the separable outer sphere 204, or the solid outer sphere 304. The diameter 608 may be defined such that a portion of the outer sphere may protrude from the housing 106 when the outer sphere is positioned in a primary cavity defined in the housing 106.

For example, with reference to FIGS. 3B and 6, the diameter 608 of the opening 606 may be less a diameter 303 of the solid outer sphere 304. The diameter 608 may be defined such that a portion 307 of the solid outer sphere 304 may protrude from the housing 106 when the solid outer sphere 304 is positioned in the primary cavity 401 defined in the housing 106.

With combined reference to FIGS. 4-6, the housing 106 may include the connection or coupling, such as the mechanical coupling. The mechanical coupling may include the first element 511 and a second element 610. The second element 610 may be configured to interface with the first element 511. The second element 610 may be positioned on the second end 604 of the collar 600. For example, the collar 600 may be placed on the handle 500 such that the second end 604 of the collar 600 contacts an upper surface 515 of the handle 500. The collar 600 may be rotated relative to the handle 500, which may engage the first element 511 of the handle 500 with the second element 610 of the collar 600.

Figure 7:
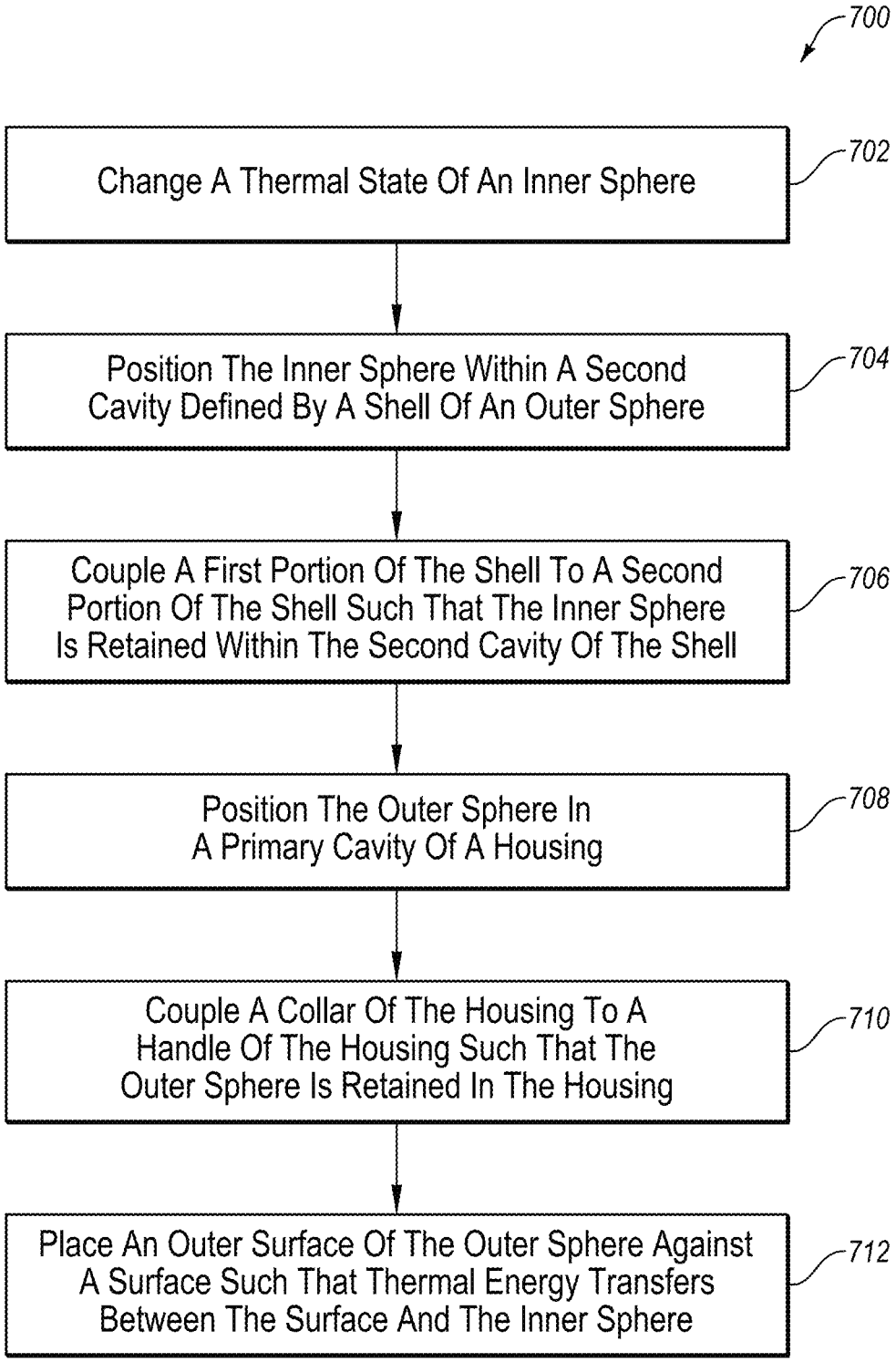
FIG. 7 illustrates a flow chart of an exemplary method of muscle massage.

FIG. 7 is a flow chart of example method 700 of muscle massage according to at least one exemplary embodiment. Although illustrated as discrete blocks, various blocks may be divided into additional blocks, combined into fewer blocks, or eliminated, depending on the desired implementation. If desired, additional blocks may be added depending, for example, upon the intended use of the ball roller assembly 100.

The method 700 may begin at block 702 in which a thermal state of an inner sphere may be changed. The changing the thermal state of an inner sphere may include placing the inner sphere in an oven, a microwave oven, or a pan of boiling water or placing the inner sphere in a freezer, chilled water, or ice. After reviewing this disclosure, it will be appreciated that the thermal state of one or more components of the ball roller assembly 100 may be changed by any suitable means or methods.

At block 704, the exemplary method may include the inner sphere positioned within a secondary cavity defined by a shell of an outer sphere 102. The inner sphere may be comprised of or may include thermal-sensitive material, such as the thermal-sensitive material with the high specific heat capacity described above. The outer sphere 102 may be comprised of a metal and/or the mechanical connection may include a threaded connection. Additionally, the secondary cavity may include a volume that is substantially similar to the volume of the inner sphere such that when the inner sphere is positioned in the secondary cavity, an outer surface of the inner sphere may contact an inner surface of the outer sphere 102.

At block 706, the exemplary method may include a first portion of the shell coupled to a second portion of the shell. For instance, the first portion of the shell may be coupled to the second portion of the shell such that the inner sphere is retained within the secondary cavity of the shell. The shell may include a first portion that is selectively attached to a second portion via a connection such as a mechanical connection. The first portion may include a first hemisphere shell and the second portion may include a second hemisphere shell.

At block 708, the exemplary method may include positioning the outer sphere 102 in a primary cavity of a housing. The housing may define the primary cavity that may be configured to retain a portion of the outer sphere 102. The housing may include a collar, a handle, and a coupling, such as a mechanical coupling, that enables selective coupling between the collar and the handle. The collar may include a ring of material having a first end and a second end. The first end of the collar may define a circular opening having a diameter that is less than a diameter of the outer sphere 102 such that a portion of the outer sphere may protrude from the housing when the outer sphere is positioned in the primary cavity. The second end of the collar may be configured to be attached to the handle. The handle may include at least one structure that is configured to support the outer sphere and retain the outer sphere against the circular opening of the collar.

At block 710, the exemplary method may include coupling the collar of the housing to the handle of the housing such that the outer sphere is retained in the housing. At block 712, the exemplary method may include an outer surface of the outer sphere 102 placed against a surface. For instance, the outer surface of the outer sphere 102 may be placed against a surface such that thermal energy transfers between the surface and the inner sphere.

Figure 8:
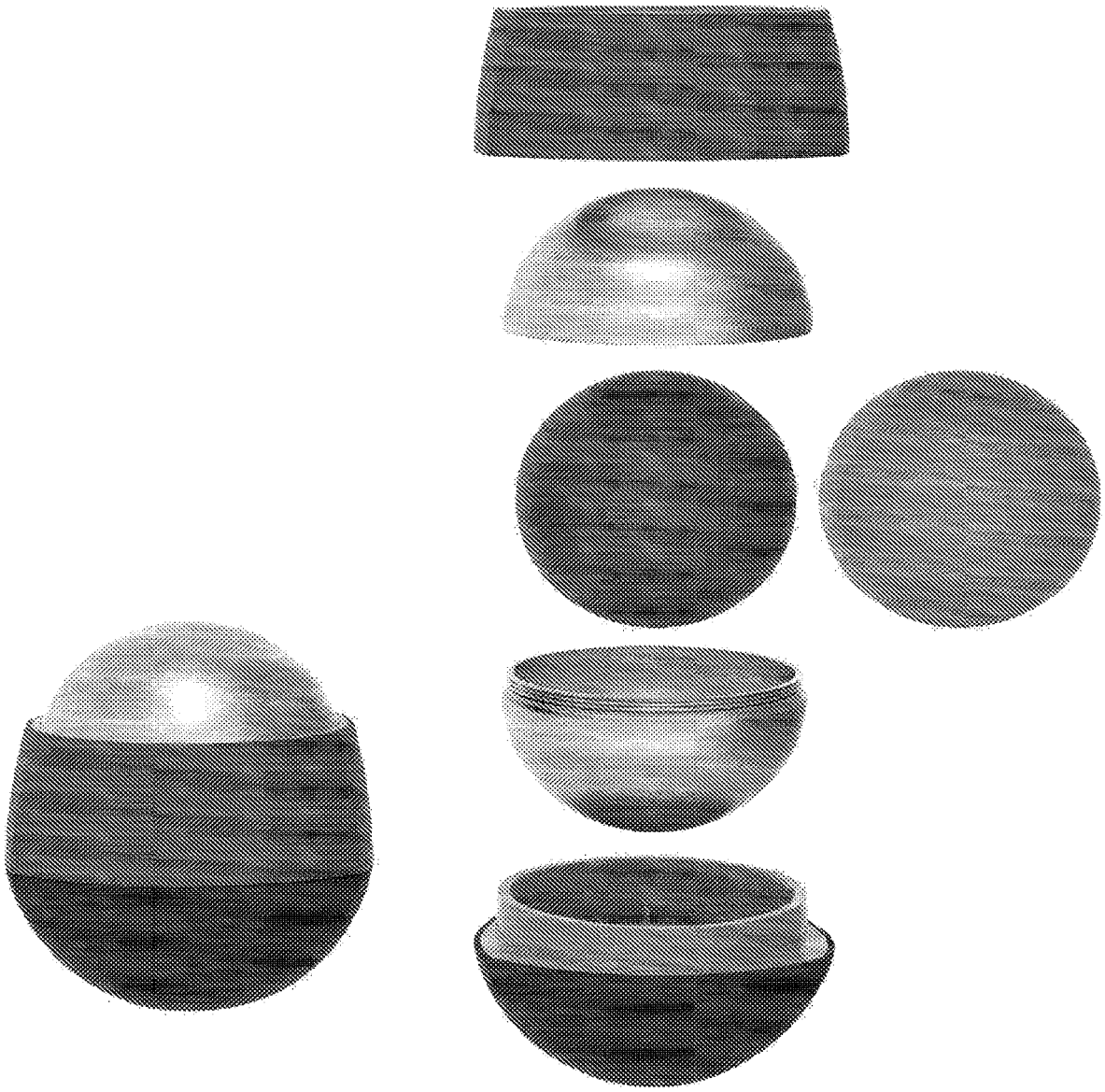
FIG. 8 illustrates a side view of an exemplary embodiment of a separable ball roller assembly and an exploded side view of an exemplary embodiment of the separable ball roller assembly with multiple inner spheres.
Figure 9:
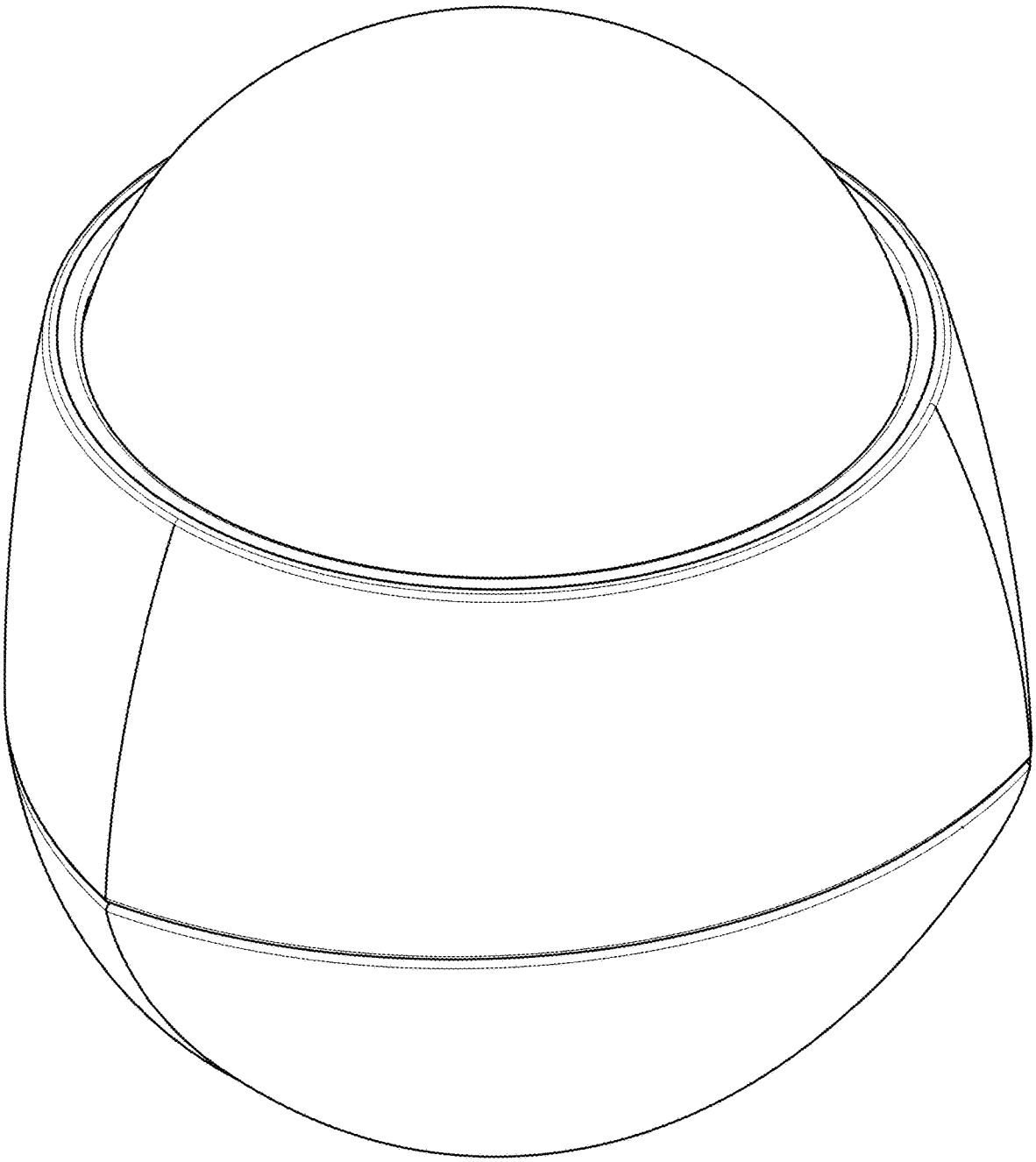
FIG. 9 is a first perspective view of an exemplary embodiment of a ball roller assembly.
Figure 10:
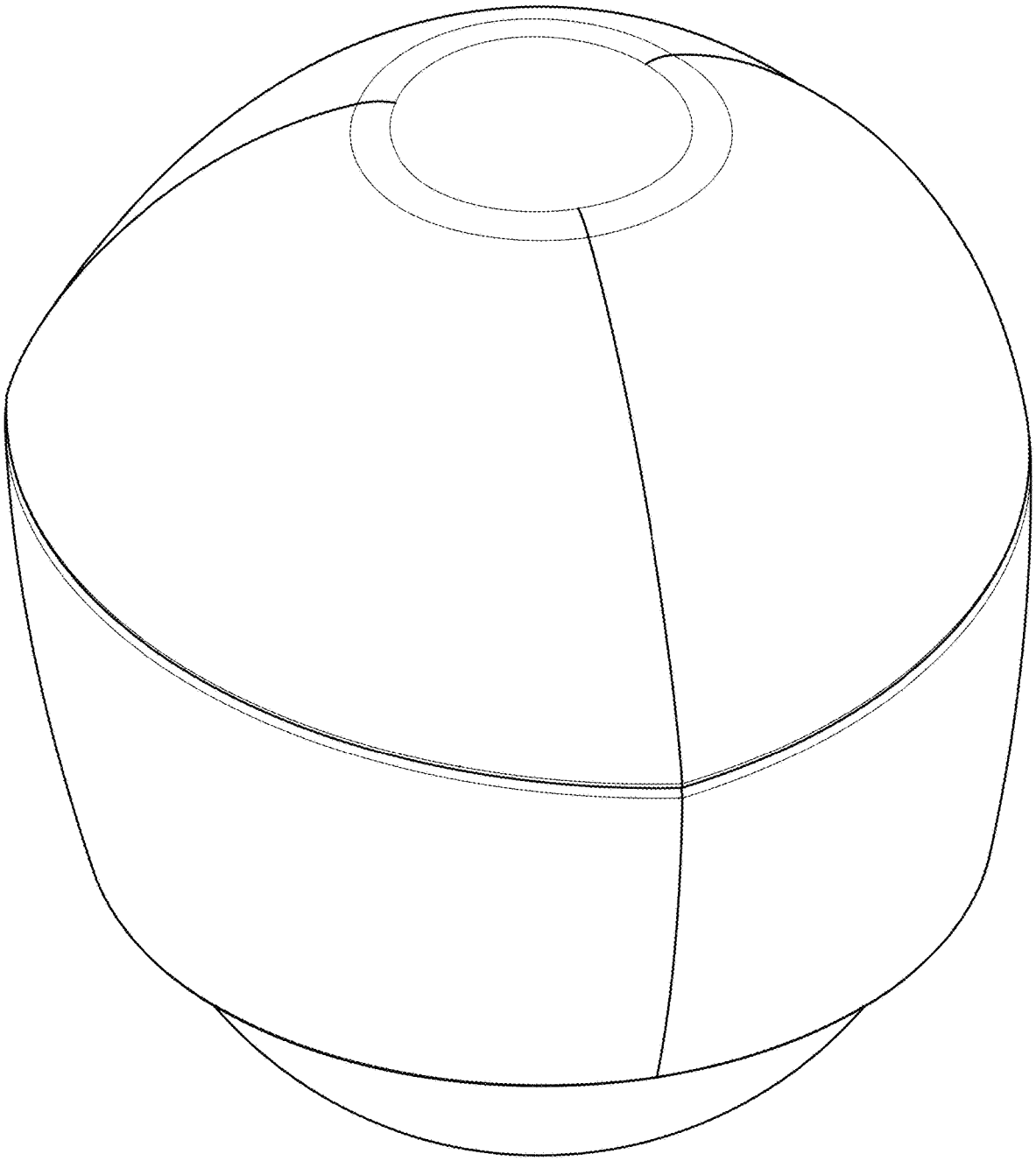
FIG. 10 is a second perspective view of the ball roller assembly of FIG. 9.
Figure 11:
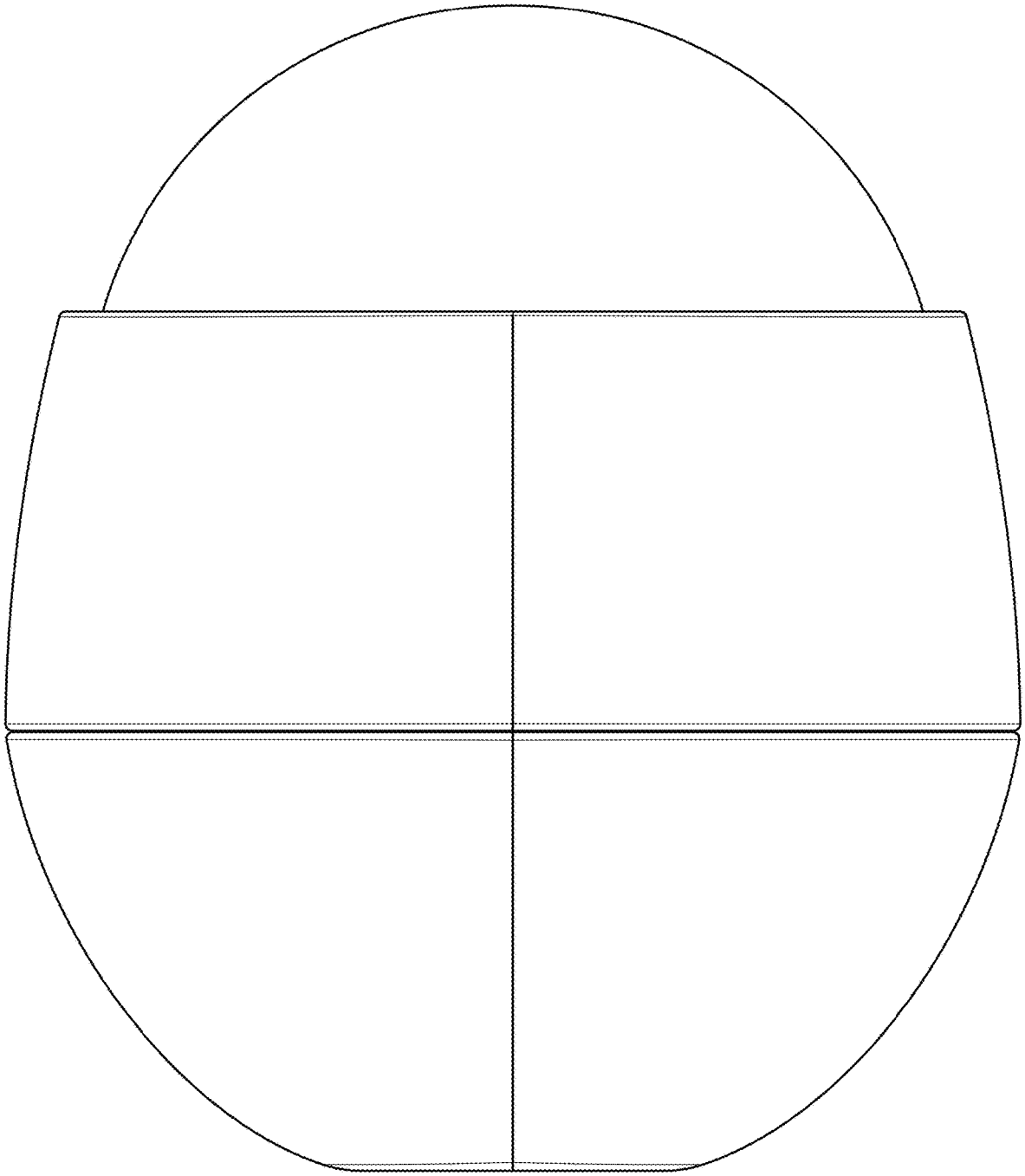
FIG. 11 is a front view of the ball roller assembly of FIG. 9.
Figure 12:
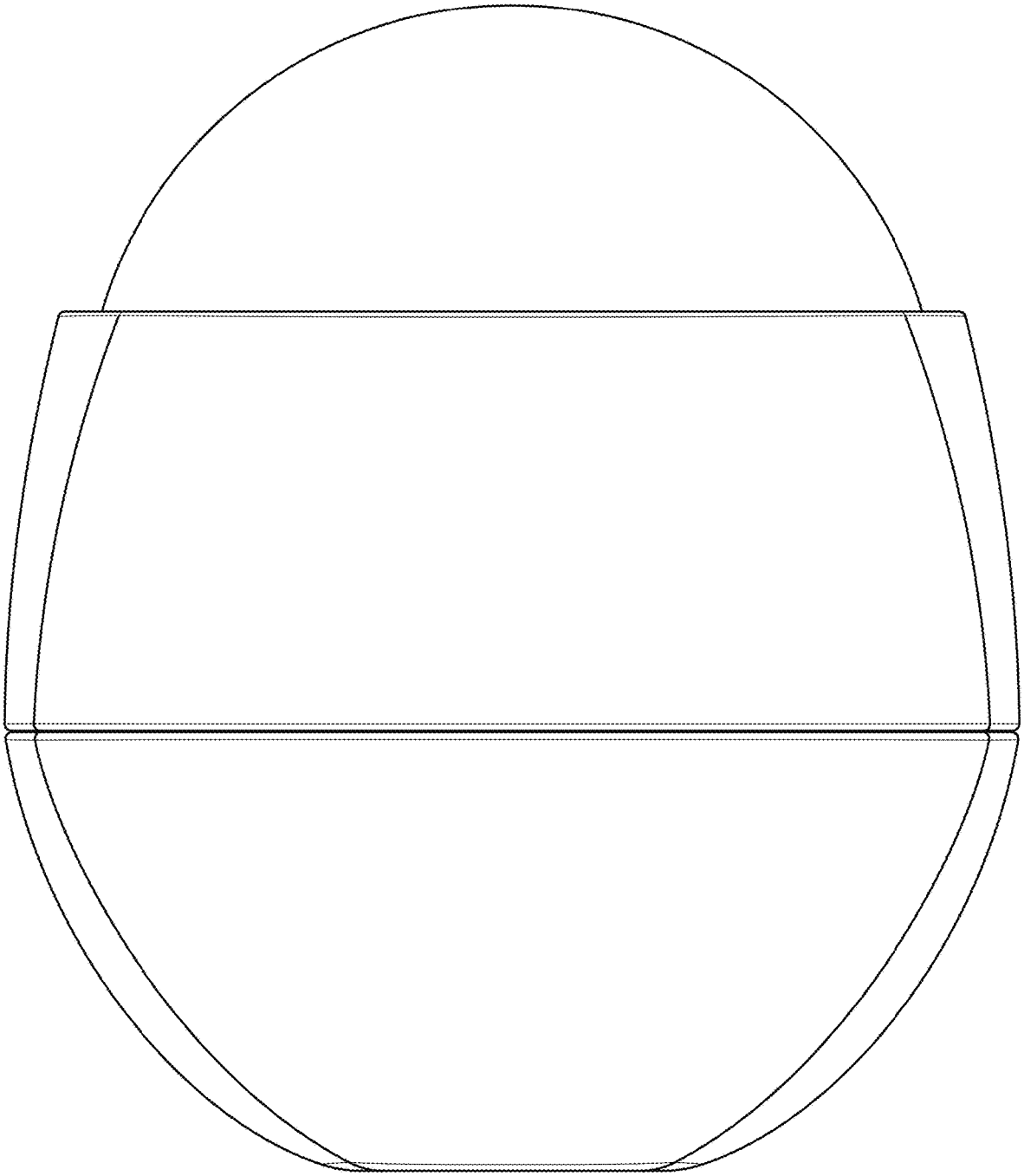
FIG. 12 is a rear view of the ball roller assembly of FIG. 9.
Figure 13:
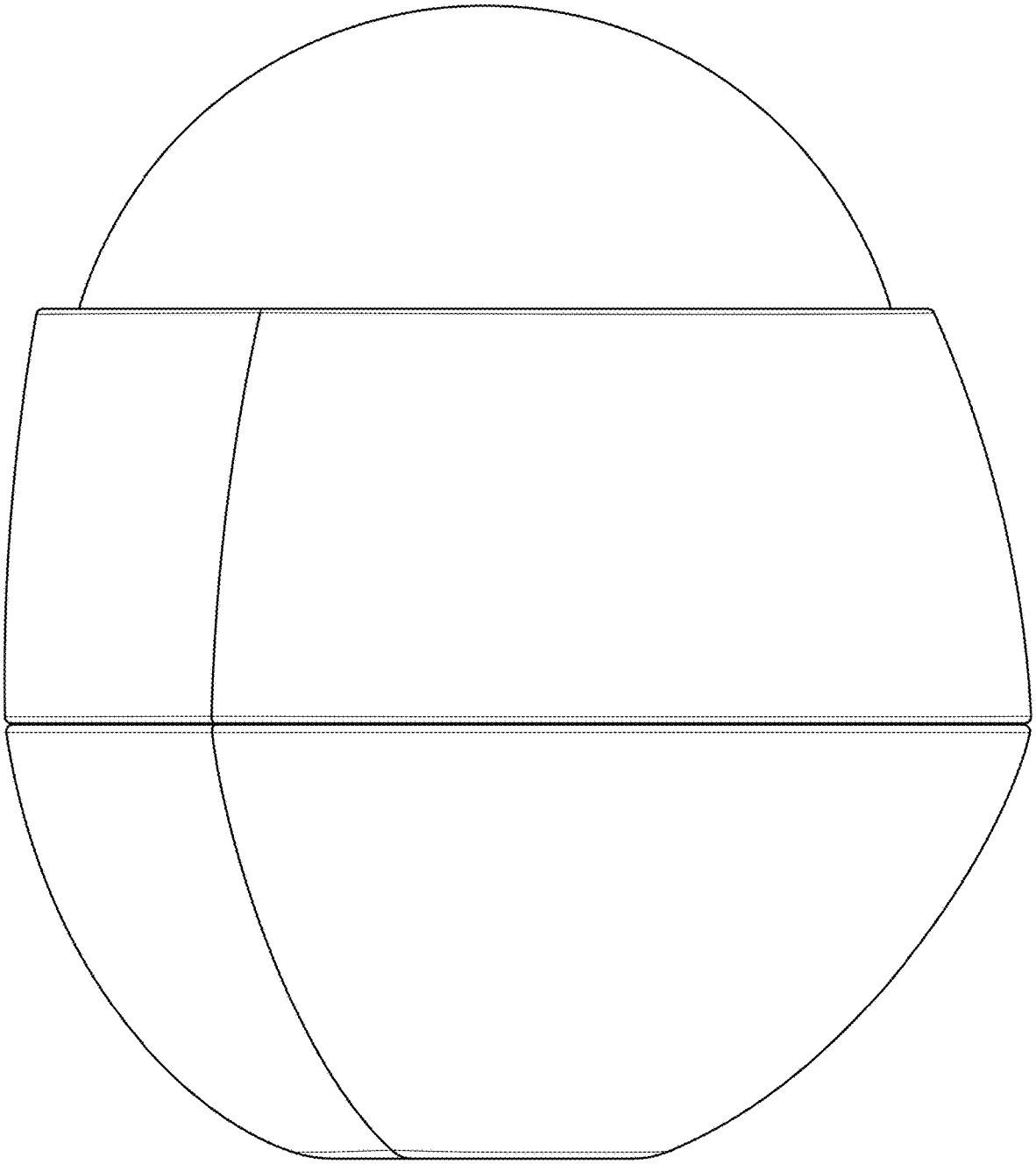
FIG. 13 is a right side view of the ball roller assembly of FIG. 9.
Figure 14:
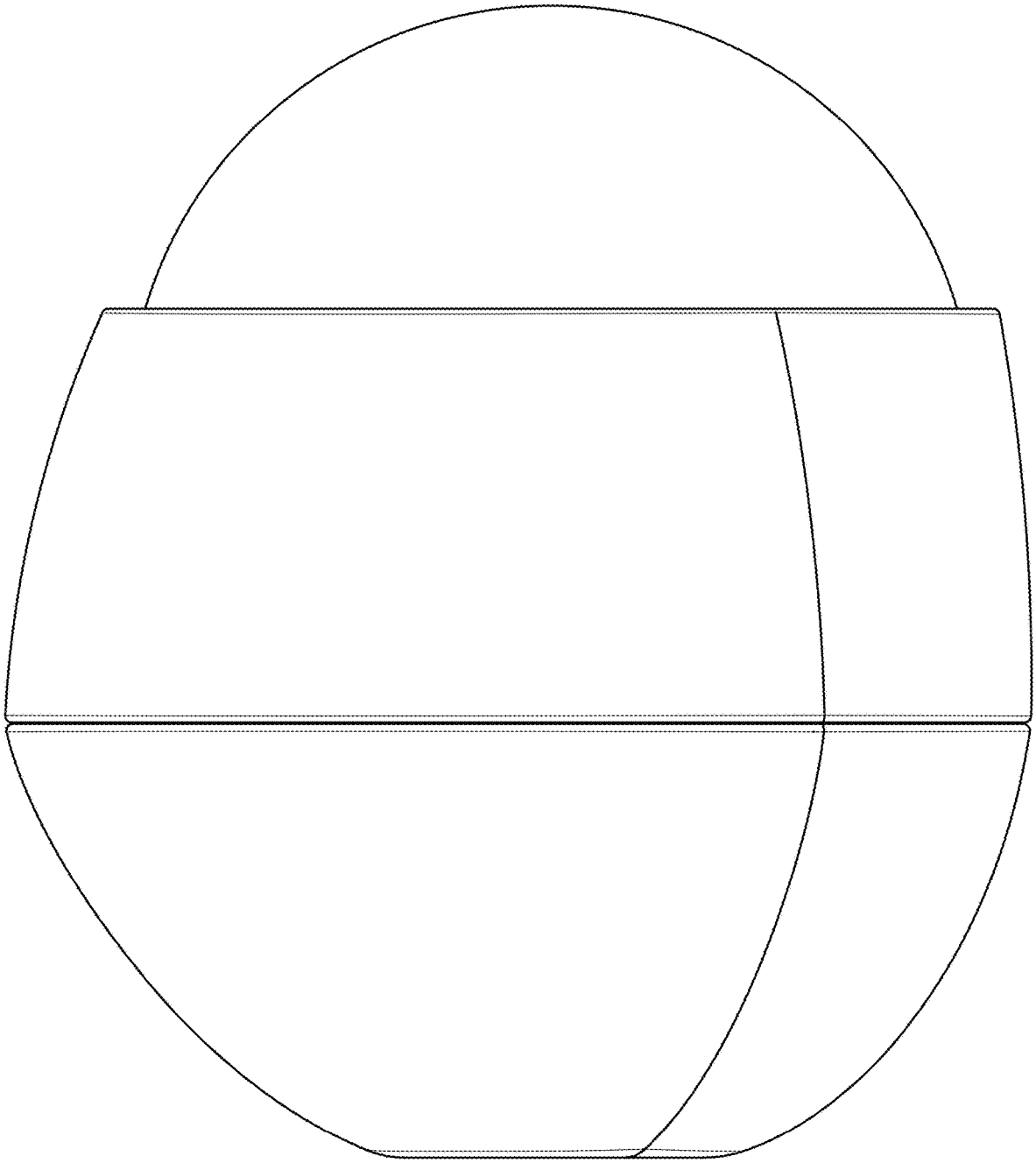
FIG. 14 is a left side view of the ball roller assembly of FIG. 9.
Figure 15:
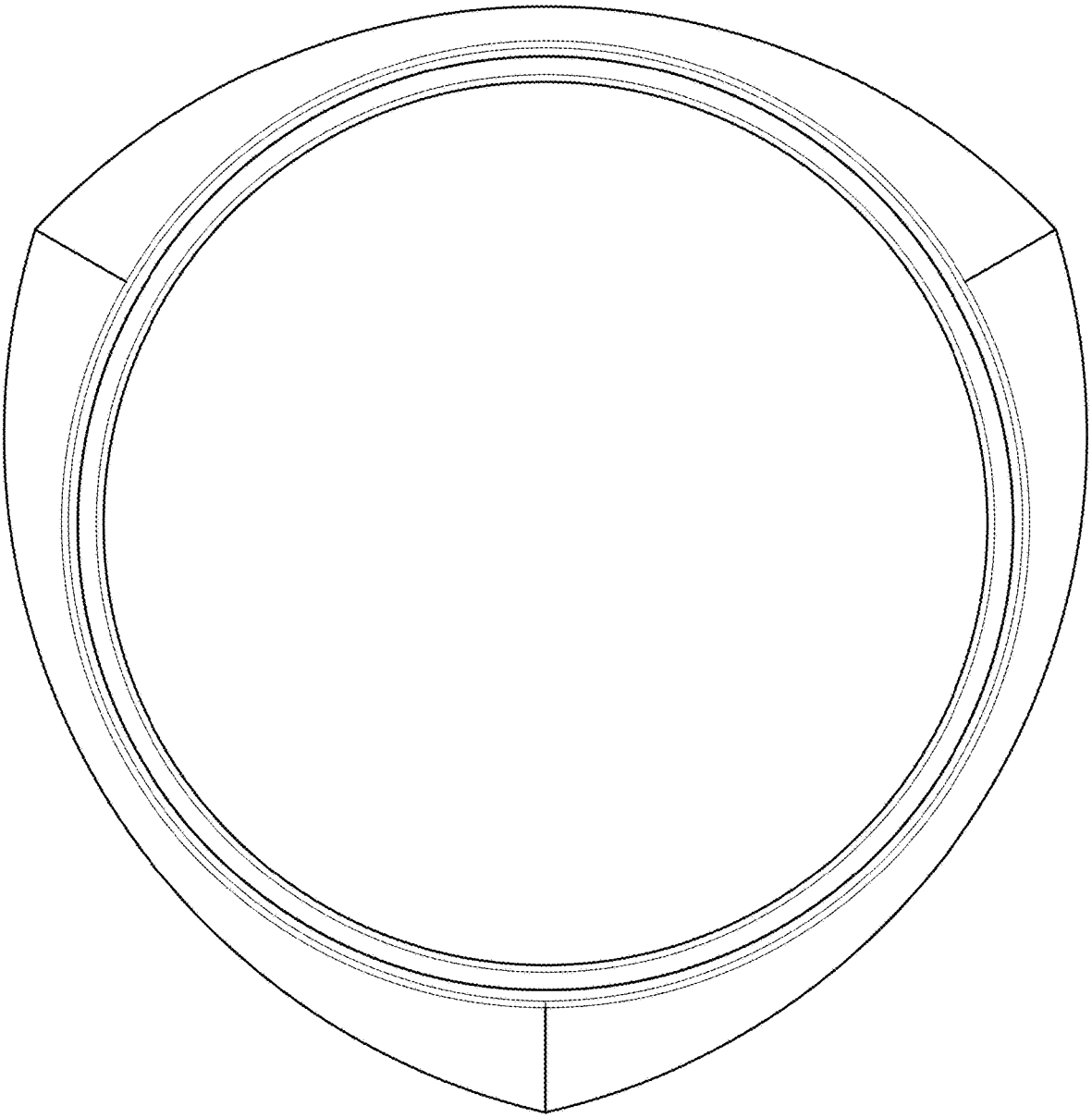
FIG. 15 is a top view of the ball roller assembly of FIG. 9.
Figure 16:
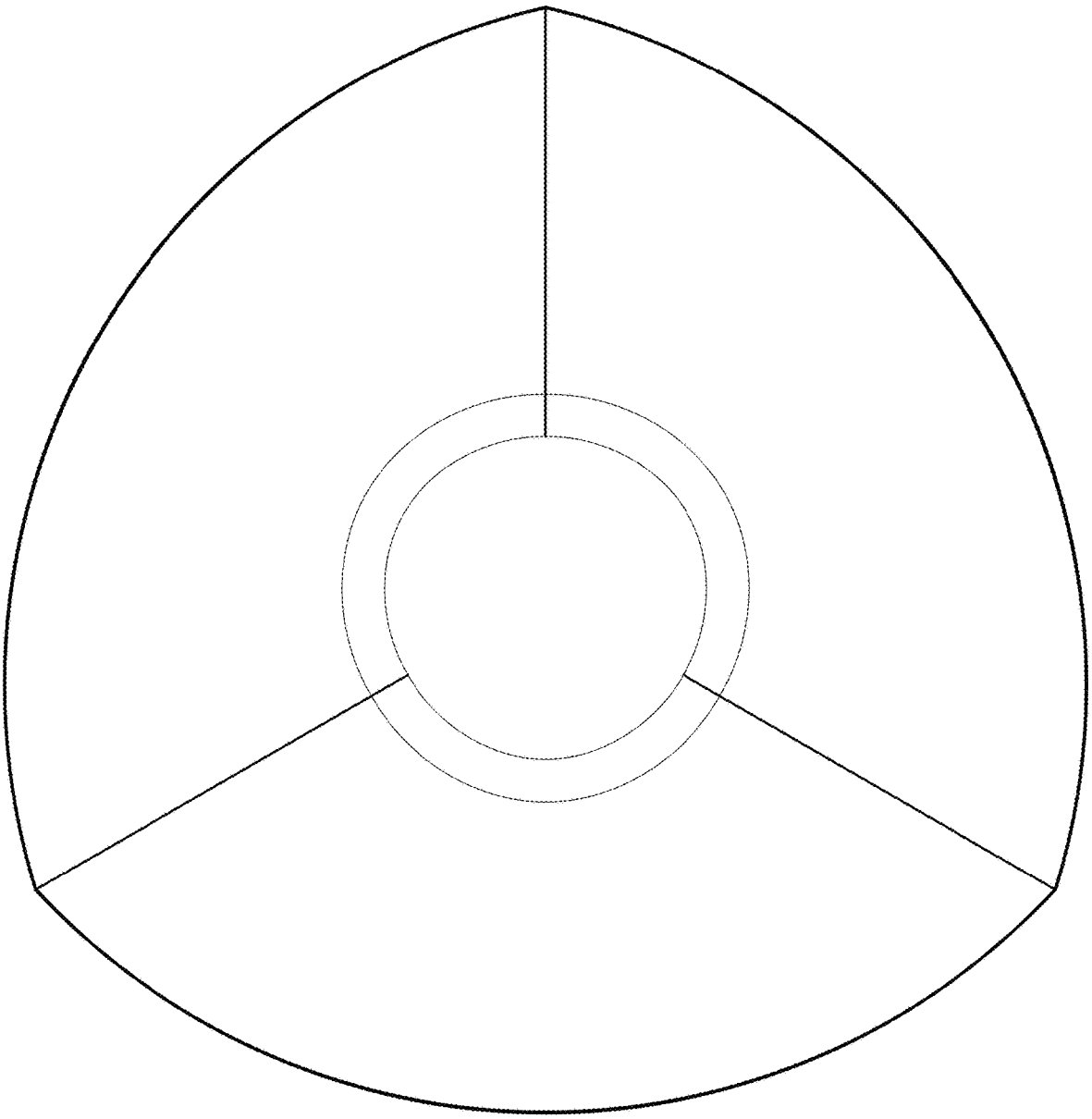
FIG. 16 is a bottom view of the ball roller assembly of FIG. 9.

FIG. 8 includes an image of an assembled view of an exemplary embodiment of a separable ball roller assembly and an image of an exploded view of the separable ball roller assembly with multiple inner spheres.

FIGS. 9-16 depict views of an exemplary embodiment of a ball roller assembly.

One skilled in the art will appreciate that, for this and other procedures and methods disclosed herein, the functions performed in the processes and methods may be implemented in differing orders. Furthermore, the outlined steps and operations are only provided as examples, and some of the steps and operations may be optional, combined into fewer steps and operations, or expanded into additional steps and operations without detracting from the disclosed embodiments.

One of ordinary skill in the art will appreciate after reviewing this disclosure that the ball roller assembly may have other suitable shapes, sizes, configurations, and arrangements depending, for example, upon the intended use of the ball roller assembly. One of ordinary skill in the art will also appreciate that different components of the ball roller assembly may have various shapes, sizes, configurations, and arrangements depending, for example, upon the intended use of the ball roller assembly. Further, one of ordinary skill in the art will appreciate the ball roller assembly may include any suitable number or combination of features or aspects.

Although this invention has been described in terms of certain exemplary embodiments, other embodiments apparent to those of ordinary skill in the art are also within the scope of this invention. Accordingly, the scope of the invention is intended to be defined only by the claims which follow.

What is claimed is:

1. A ball roller assembly comprising:

an outer sphere comprising a shell and a secondary cavity having a spherical shape and defining a volume;

a first inner sphere with a changeable thermal state positionable within and removable from the secondary cavity of the outer sphere to enable thermal transfer from the first inner sphere to the outer sphere, the first inner sphere having a spherical outer surface and having a first volume that substantially fills the volume of the secondary cavity;

a second inner sphere with a changeable thermal state positionable within and removable from the secondary cavity of the outer sphere to enable thermal transfer from the second inner sphere to the outer sphere, the second inner sphere having a spherical outer surface and having a second volume that substantially fills the volume of the secondary cavity; and a housing that retains the outer sphere such that the outer sphere is rotatable within the housing, the housing comprising:

support structures that protrude from an inner surface of the housing into a primary cavity of the housing to support the outer sphere, the support structures including a ring-shaped protrusion and a plurality of radial protrusions around the ring-shaped protrusion with edges having shapes that correspond to the outer sphere, wherein the edges are curved in a radial direction and configured to contact the outer sphere.

2. The ball roller assembly of claim 1, wherein the shell of the outer sphere includes a first portion that is selectively attached to a second portion of the shell via a mechanical connection.

3. The ball roller assembly of claim 2, wherein the first portion of the shell includes a first hemisphere and the second portion of the shell includes a second hemisphere.

4. The ball roller assembly of claim 2, wherein the outer sphere is comprised of a metal.

5. The ball roller assembly of claim 2, wherein the mechanical connection includes a threaded connection.

6. The ball roller assembly of claim 1, wherein an outer surface of each of the first inner sphere and the second inner sphere contacts an inner surface of the outer sphere when the first inner sphere or the second inner sphere is positioned within the secondary cavity of the outer sphere.

7. The ball roller assembly of claim 1, wherein:

the housing defines a primary cavity that retains a portion of the outer sphere;

the housing includes a collar, a handle, and a coupling that selectively couples the collar to the handle;

the collar includes a ring with a first end and a second end;

the first end of the ring of the collar defines a circular opening having a diameter that is less than a diameter of the outer sphere such that a portion of the outer sphere protrudes from the housing when the outer sphere is positioned in the primary cavity;

the second end of the ring of the collar is attachable to the handle; and the handle supports the outer sphere and retains the outer sphere against the circular opening of the first end of the ring of the collar.

8. The ball roller assembly of claim 1, wherein each of the first inner sphere and the second inner sphere includes a thermally sensitive material having a high specific heat capacity.

9. The ball roller assembly of claim 8, wherein the thermally sensitive material of the first inner sphere comprises a gel with a changeable thermal state that comprises a cooled thermal state.

10. The ball roller assembly of claim 8, wherein the thermally sensitive material of the second inner sphere comprises a gel with a changeable thermal state that comprises a heated thermal state.

11. The ball roller assembly of claim 8, wherein the thermally sensitive material comprises a supersaturated solution of sodium acetate in water, sodium polyacrylate, a salt hydrate, a diethylene glycol, an ethylene glycol, an ammonium nitrate, a calcium ammonium nitrate, a paraffin, or urea.

12. A method of muscle massage, comprising:

changing a thermal state of an inner sphere having a spherical outer surface;

after changing the thermal state of the inner sphere, placing the inner sphere within a first hemispherical secondary cavity of a first portion of a shell of an outer sphere and within a second hemispherical secondary cavity of a second portion of the shell of the outer sphere;

coupling the second portion of the shell of the outer sphere to the first portion of the shell of the outer sphere such that the inner sphere is secured within a secondary cavity of the shell, a volume of the inner sphere substantially filling a volume of a spherical secondary cavity of the shell defined by the first hemispherical secondary cavity of the first portion of the shell and the second hemispherical secondary cavity of the second portion of the shell;

placing the outer sphere in a primary cavity of a housing, the housing comprising support structures that protrude from an inner surface of the housing into the primary cavity of the housing to support the outer sphere, the support structures including a ring-shaped protrusion and a plurality of radial protrusions around the ring-shaped protrusion with edges having shapes that correspond to the outer sphere, wherein the edges are curved in a radial direction and configured to contact the outer sphere;

coupling a collar of the housing to a handle of the housing to retain the outer sphere within the primary cavity of the housing; and pressing an outer surface of the outer sphere against a surface of a user's body part and moving the outer sphere relative to the user's body part.

13. The method of claim 12, wherein:

coupling the second portion of the shell of the outer sphere to the first portion of the shell of the outer sphere comprises screwing the first portion of the shell of the outer sphere onto the second portion of the shell of the outer sphere.

14. The method of claim 12, wherein:

coupling the collar of the housing to the handle of the housing includes coupling a ring having a first end and a second end to the handle of the housing, the first end of the ring defining a circular opening having a diameter that is less than a diameter of the outer sphere such that a portion of the outer sphere protrudes from the housing when the outer sphere is located in the primary cavity, the second end of the ring being attachable to the handle, and the handle supporting the outer sphere and retaining the outer sphere against the circular opening of the first end of the ring of the collar.

15. The method of claim 12, wherein placing the inner sphere within the secondary cavity of the first portion of the shell of the outer sphere and within the secondary cavity of the second portion of the shell of the outer sphere comprises placing an inner sphere comprising a thermally sensitive material having a high specific heat capacity within the secondary cavity of the first portion of the shell of the outer sphere and within the secondary cavity of the second portion of the shell of the outer sphere.

16. The method of claim 15, wherein the placing the inner sphere comprising the thermally sensitive material within the secondary cavity of the first portion of the shell of the outer sphere and within the secondary cavity of the second portion of the shell of the outer sphere comprises placing an inner sphere containing a supersaturated solution of sodium acetate in water, sodium polyacrylate, a salt hydrate, a diethylene glycol, an ethylene glycol, an ammonium nitrate, a calcium ammonium nitrate, a paraffin, or urea within the secondary cavity of the first portion of the shell of the outer sphere and within the secondary cavity of the second portion of the shell of the outer sphere.

17. The method of claim 15, wherein placing the inner sphere comprising the thermally sensitive material within the secondary cavity of the first portion of the shell of the outer sphere and within the secondary cavity of the second portion of the shell of the outer sphere comprises placing an inner sphere containing a gel that can be cooled and can cool the outer sphere within the secondary cavity of the first portion of the shell of the outer sphere and within the secondary cavity of the second portion of the shell of the outer sphere.

18. The method of claim 15, wherein placing the inner sphere comprising the thermally sensitive material within the secondary cavity of the first portion of the shell of the outer sphere and within the secondary cavity of the second portion of the shell of the outer sphere comprises placing an inner sphere containing a gel that can be heated and can heat the outer sphere within the secondary cavity of the first portion of the shell of the outer sphere and within the secondary cavity of the second portion of the shell of the outer sphere.

19. A ball roller assembly comprising:

an outer sphere constructed from a thermally conductive material;

an inner sphere disposable within and substantially filling a volume of a cavity of the outer sphere to facilitate thermal transfer between the inner sphere, the outer sphere, and a user of the ball roller assembly, the inner sphere having a spherical outer surface; and a housing constructed from a thermally non-conductive material, the housing comprising support structures that protrude from an inner surface of the housing into a primary cavity of the housing to support the outer sphere, the support structures including a ring-shaped protrusion and a plurality of radial protrusions around the ring-shaped protrusion with edges having shapes that correspond to the outer sphere, wherein the edges are curved in a radial direction and configured to contact the outer sphere disposed within the housing.

20. The ball roller assembly of claim 19, wherein:

the inner sphere is selectively removable from the outer sphere; and the outer sphere is selectively removable from the housing.

* * * * *